US011753810B2

(12) United States Patent
Barker

(10) Patent No.: US 11,753,810 B2
(45) Date of Patent: Sep. 12, 2023

(54) MODULAR ARM FOR FIXTURE CARRIER

(71) Applicant: Zurn Industries, LLC, Milwaukee, WI (US)

(72) Inventor: Lisa A. Barker, Cranesville, PA (US)

(73) Assignee: Zurn Industries, LLC, Milwaukee, WI (US)

( * ) Notice: Subject to any disclaimer, the term of this patent is extended or adjusted under 35 U.S.C. 154(b) by 113 days.

(21) Appl. No.: 17/220,612

(22) Filed: Apr. 1, 2021

(65) Prior Publication Data

US 2021/0310229 A1 Oct. 7, 2021

Related U.S. Application Data

(60) Provisional application No. 63/003,796, filed on Apr. 1, 2020.

(51) Int. Cl.
*E03D 11/14* (2006.01)
*E03C 1/328* (2006.01)

(52) U.S. Cl.
CPC ..... *E03D 11/143* (2013.01); *E03C 1/328* (2013.01)

(58) Field of Classification Search
CPC ..... E03D 11/143; E03D 11/14
USPC ..... 4/252.2
See application file for complete search history.

(56) References Cited

U.S. PATENT DOCUMENTS 899,956 A 9/1908 Coons
1,078,546 A 11/1913 McCarthy et al.
1,657,020 A 1/1928 Mason
1,930,314 A 10/1933 Healy et al.
2,264,082 A 11/1941 Kintz
2,283,794 A 5/1942 Crozier
2,716,757 A 9/1955 Eriksson
2,810,917 A 10/1957 Rhoades, Jr.
2,819,473 A 1/1958 Baker et al.
2,903,712 A 9/1959 Morris et al.
2,937,381 A * 5/1960 Manas ..... E03C 1/32 248/122.1
2,938,381 A 5/1960 Smith et al.
3,011,177 A 12/1961 Haughey
3,014,223 A 12/1961 Pope
RE25,175 E 5/1962 Nelson et al.
3,098,242 A 7/1963 Armbruster et al.
3,273,173 A 9/1966 Morris et al.
3,286,280 A 11/1966 Duggan
3,323,143 A 6/1967 Pope
3,364,503 A 1/1968 Mustee
(Continued)

OTHER PUBLICATIONS www.fastenright.com Double End Threaded Bar dated Jan. 22, 2019 printed Dec. 30, 22 (Year: 2019).*
(Continued)

*Primary Examiner* — Christine J Skubinna
(74) *Attorney, Agent, or Firm* — Husch Blackwell LLP

(57) ABSTRACT

A fixture carrier for supporting a plumbing fixture includes an upright and an arm. The arm is coupled to the upright and is configured to support the plumbing fixture. The arm includes a base, and an extension configured to move relative to the base. The arm is configurable in a first position where at least a portion of the base is retracted into the extension, a second position where the extension is extended away from the base, and a plurality of positions between the first position and the second position.

10 Claims, 22 Drawing Sheets

(56) References Cited

U.S. PATENT DOCUMENTS

| | | | |
|---|---|---|---|
| 3,398,409 | A | 8/1968 | Pope |
| 3,440,670 | A | 4/1969 | VanHoof |
| 3,611,451 | A | 10/1971 | Armstrong |
| 3,765,036 | A | 10/1973 | Dykstra |
| 3,810,597 | A | 5/1974 | Flegel et al. |
| 3,932,899 | A | 1/1976 | Brady et al. |
| 4,058,859 | A | 11/1977 | Arrowood |
| 4,158,898 | A | 6/1979 | Denhart |
| 4,434,516 | A | 3/1984 | Morris et al. |
| 4,541,602 | A | 9/1985 | Potzas |
| 4,979,239 | A | 12/1990 | Klein et al. |
| 5,044,584 | A | 9/1991 | Lin |
| 5,050,253 | A | 9/1991 | Wasek |
| 5,090,064 | A | 2/1992 | Breitenberger |
| 5,148,552 | A | 9/1992 | Kress et al. |
| 5,167,040 | A | 12/1992 | Lechner |
| 5,210,883 | A | 5/1993 | Weber et al. |
| 5,230,109 | A | 7/1993 | Zaccai et al. |
| 5,265,284 | A | 11/1993 | Dottori et al. |
| 5,407,171 | A | 4/1995 | Gonzalez |
| 5,491,932 | A | 2/1996 | Elliott |
| 5,617,962 | A | 4/1997 | Chen |
| 5,660,637 | A | 8/1997 | Dodge |
| 5,697,650 | A | 12/1997 | Brown |
| 5,724,773 | A | 3/1998 | Hall |
| 5,752,679 | A | 5/1998 | Thomason |
| 6,035,589 | A | 3/2000 | Schmucki et al. |
| 6,129,320 | A | 10/2000 | Warren-Pfaeffle |
| 6,131,957 | A | 10/2000 | Saito |
| 6,301,838 | B1 | 10/2001 | Hall |
| 6,360,381 | B1 | 3/2002 | Fitzgerald, Sr. |
| 6,460,204 | B1 | 10/2002 | Krist et al. |
| 6,803,521 | B2 | 10/2004 | Vrame |
| 6,820,290 | B1 | 11/2004 | Mullick et al. |
| 6,979,027 | B2 | 12/2005 | Hetzler et al. |
| 7,096,520 | B2 | 8/2006 | Nicolia et al. |
| 7,191,794 | B2 | 3/2007 | Hodges |
| 7,426,937 | B2 | 9/2008 | Doverspike |
| 7,458,389 | B2 | 12/2008 | Doverspike |
| 7,571,497 | B2 | 8/2009 | Hetzler et al. |
| 8,141,177 | B1 | 3/2012 | Majocka et al. |
| 8,356,367 | B2 | 1/2013 | Flynn |
| 8,359,678 | B1 * | 1/2013 | Burdette ..... E03D 11/143 4/252.2 |
| 8,544,121 | B1 | 10/2013 | Majocka et al. |
| 8,887,319 | B2 | 11/2014 | Whiteside |
| 9,328,493 | B2 | 5/2016 | Wroblewski et al. |
| 2004/0222179 | A1 | 11/2004 | Garcia |
| 2005/0211852 | A1 * | 9/2005 | Nicolia ..... E03D 11/143 248/68.1 |
| 2005/0251908 | A1 | 11/2005 | Doverspike |
| 2006/0102813 | A1 * | 5/2006 | Hetzler ..... E03C 1/326 248/127 |
| 2009/0126103 | A1 | 5/2009 | Dietrich et al. |
| 2013/0205494 | A1 | 8/2013 | Whiteside |
| 2014/0020173 | A1 | 1/2014 | Sargiani |

OTHER PUBLICATIONS

Jay R. Smith Mfg. Co., Labor Saver for Wheelchair Lavatories—Floor Mounted, Product Literature Sheets, 2019 (5 Pages).

Zurn, "Z1231-EZR Concealed Arm Carrier System for Wall Hung Lavatory W/Adjustable Uprights & Header Plates," Specification Sheet, <https://www.zurn.com/media-library/web_documents/pdfs/specsheets/84450-pdf>, web page publicly available before Apr. 1, 2020 (1 page).

Zurn, "Z1231 Concealed Arm System Wall Lavatories," Specification Sheet <https://www.zurn.com/media-library/web_documents/pdfs/specsheets/58855-pdf>, web page publicly available before Apr. 1, 2020 (1 page).

Jay R. Smith Mfg. Co., "0710-M24 Labor Saver Upright Support—Floor Mounted," <https://www.jrsmith.com/product.aspx?ProductId=69>, web page publicly available before Apr. 1, 2020 (3 pages).

Watts, "TCA-411 Floor Mounted Concealed Arm Track Lavatory Carrier," <https://www.watts.com/products/drainage-solutions/fixture-carriers/tca-411>, web page publicly available before Apr. 1, 2020 (1 page).

Mifab, "MC-41 Single Carrier with Concealed Arms," <https://www.mifab.com/products/mc-41-single-carrier-with-concealed-arms/>, web page publicly available before Apr. 1, 2020 (2 pages).

Josam, "17100 Concealed Arm Carrier—Labor Saving Product Enhancement," <https://www.josam.com/17100-lavatory-carrier/>, web page publicly available before Apr. 1, 2020 (1 page).

* cited by examiner

MODULAR ARM FOR FIXTURE CARRIER

CROSS-REFERENCE TO RELATED APPLICATIONS

This application is a non-provisional of and claims benefit of U.S. Provisional Patent Application No. 63/003,796, filed on Apr. 1, 2020, the entire contents of which are incorporated herein by reference.

FIELD OF THE INVENTION

The present disclosure relates to a fixture carrier for supporting a plumbing fixture, and more specifically, to a fixture carrier including a modular arm.

BACKGROUND

Fixture carriers are used to support plumbing fixtures, such as service sinks, lavatories, urinals, water coolers, etc. during installation. Fixture carriers typically include a stationary arm configured to support plumbing fixtures of a specific shape and size. As such, when installing fixtures of different sizes, a user may need to use various different fixture carriers, which include different arms having different size capacities.

SUMMARY

In one aspect, the invention provides a fixture carrier for supporting a plumbing fixture, including an upright, and an arm coupled to the upright and configured to support the plumbing fixture, the arm including a base, and an extension configured to move relative to the base, wherein the arm is configurable in a first position where at least a portion of the base is retracted into the extension, a second position where the extension is extended away from the base, and a plurality of positions between the first position and the second position.

In another aspect, the invention provides a fixture carrier for supporting a plumbing fixture, including an upright, and an arm coupled to the upright and configured to support the plumbing fixture, the arm including a first portion coupled to the upright, and a second portion coupled to the first portion and including a bore, wherein the first portion is configured to be threadably received within the bore.

In another aspect, the invention provides a fixture carrier for supporting a plumbing fixture, including an upright defining a first axis, a cross-bar coupled to the upright and defining a second axis oriented perpendicular to the first axis, a coupling mechanism coupled to the upright, and an arm configured to support the plumbing fixture and defining a third axis oriented perpendicular to the first axis and the second axis, wherein the arm includes a first portion removably coupled to the coupling mechanism, and a second portion removably coupled to the first portion, wherein the second portion is configured to move about the third axis relative to the first portion.

Other aspects of the disclosure will become apparent by consideration of the detailed description and accompanying drawings.

DETAILED DESCRIPTION

Figure 1:
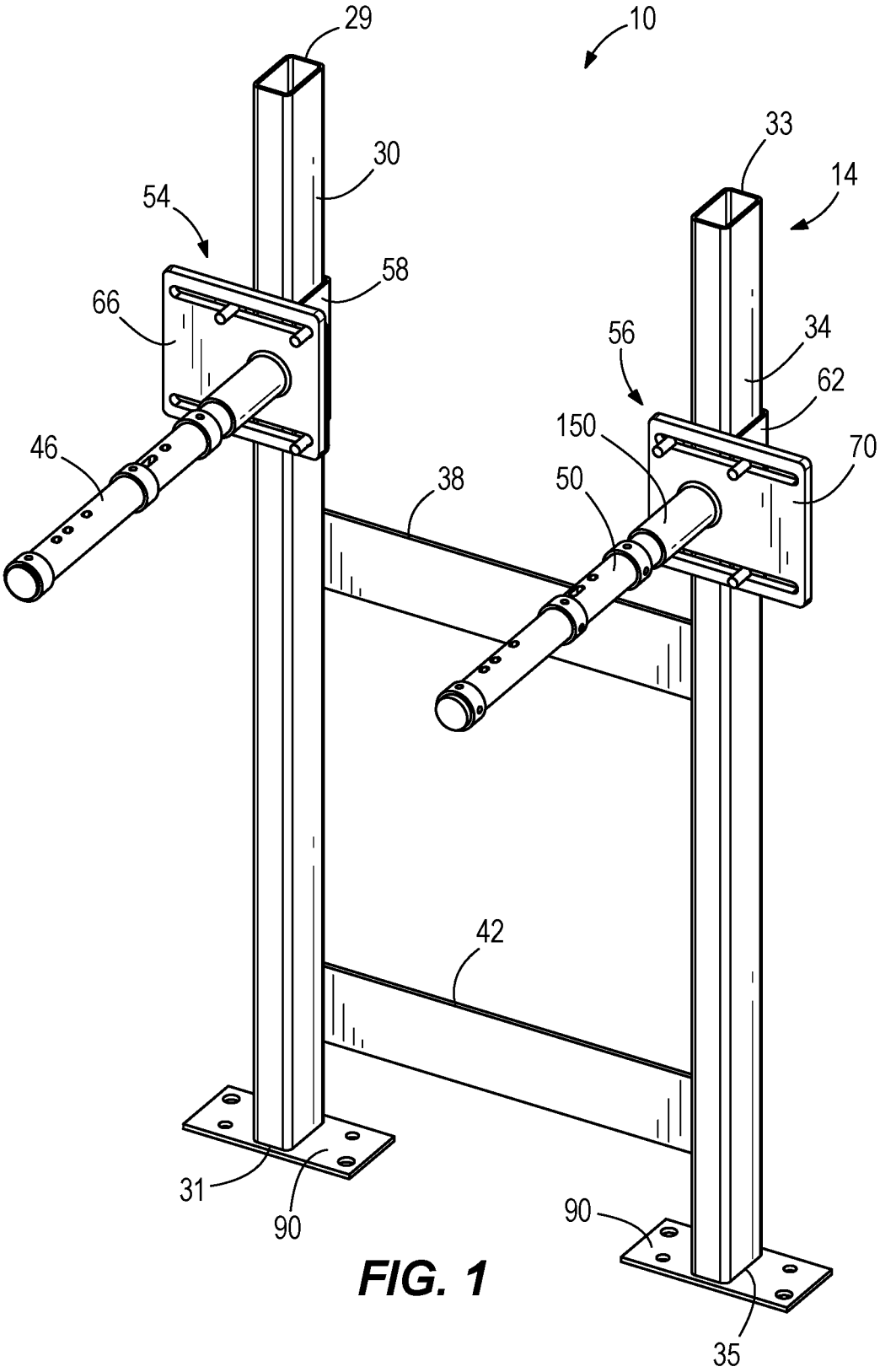
FIG. 1 is a front perspective view of a fixture carrier for supporting a plumbing fixture embodying the invention.
Figure 2:
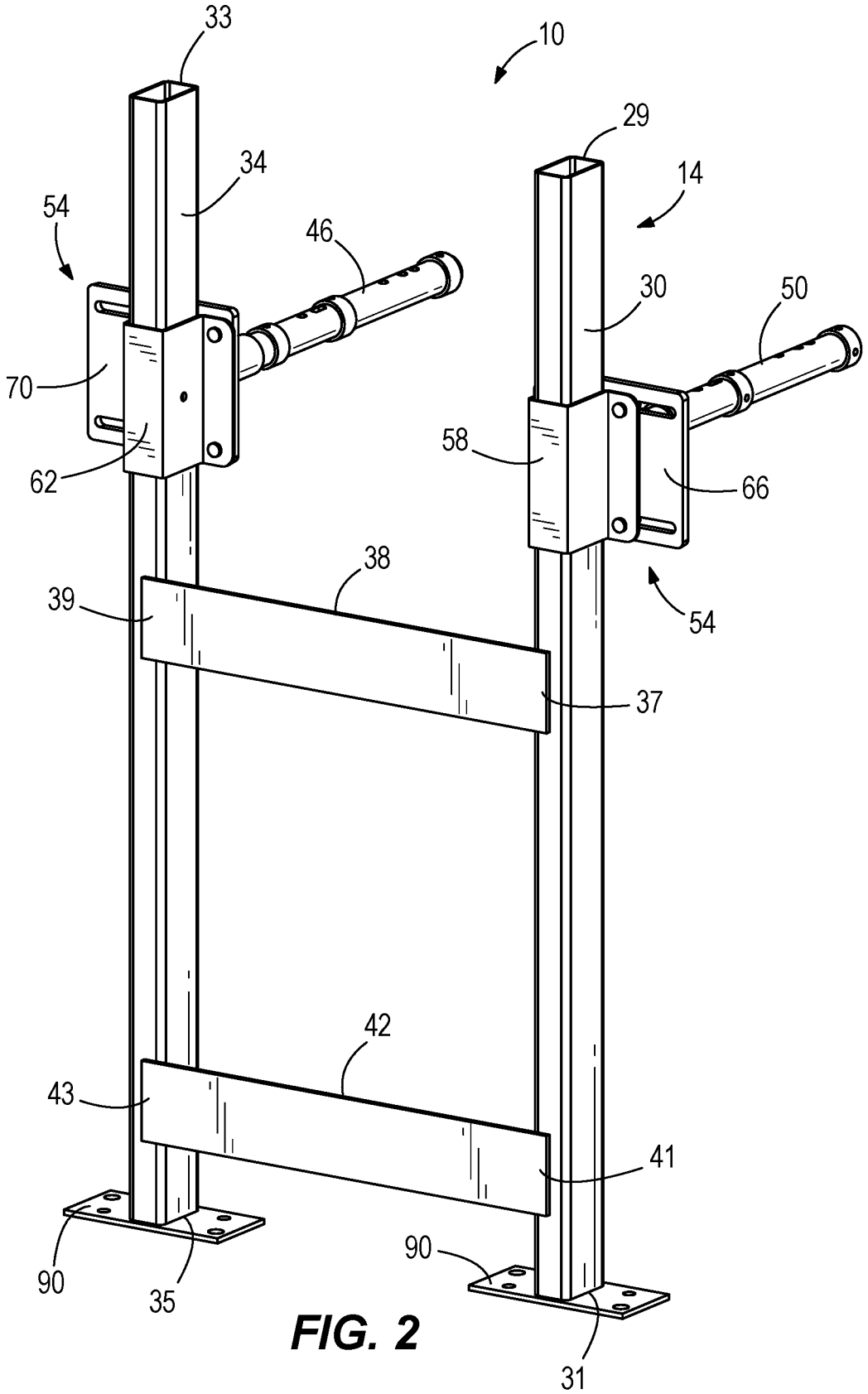
FIG. 2 is a rear perspective view of the fixture carrier of FIG. 1.
Figure 3:
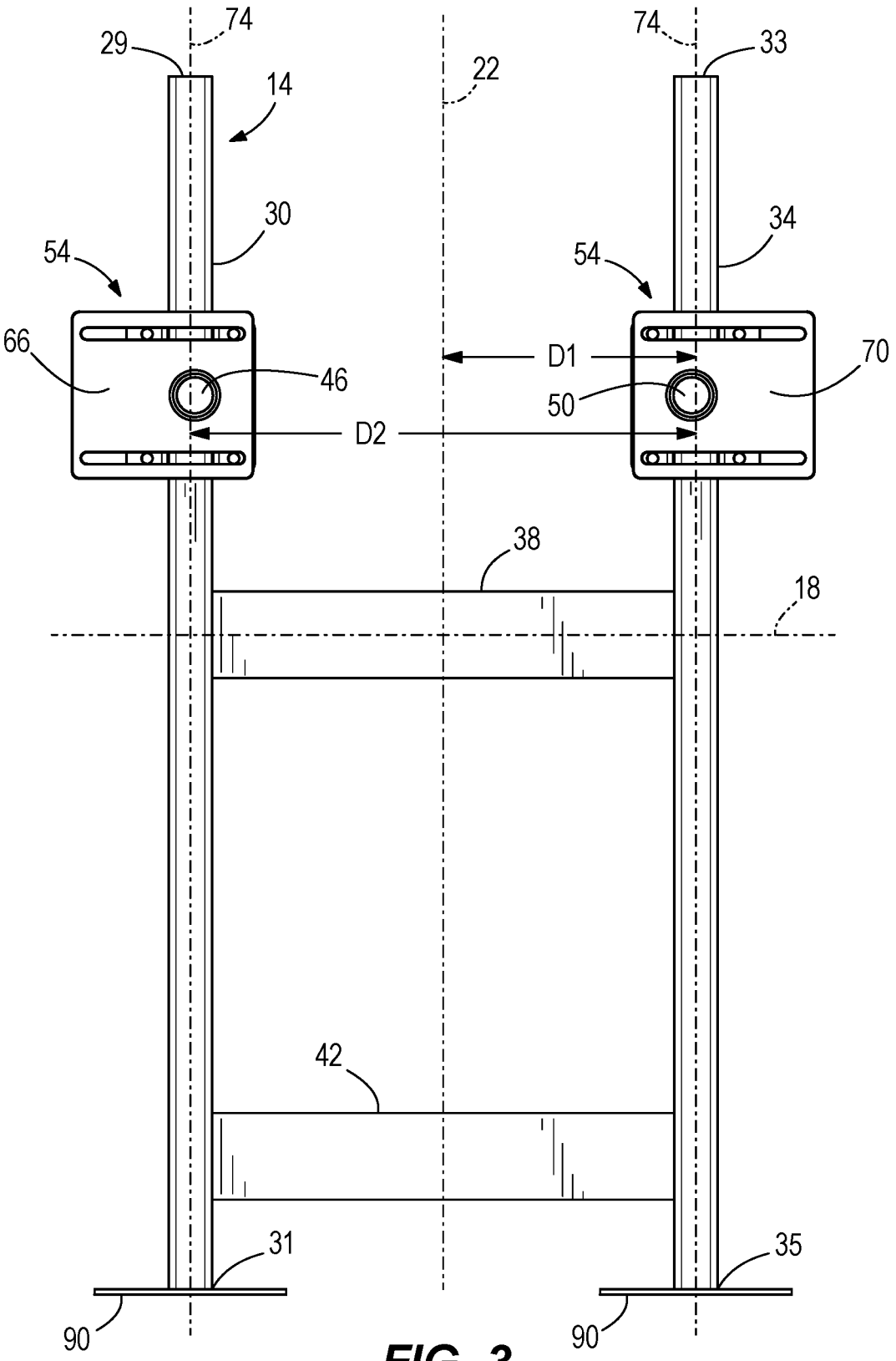
FIG. 3 is a front view of the fixture carrier of FIG. 1.
Figure 4:
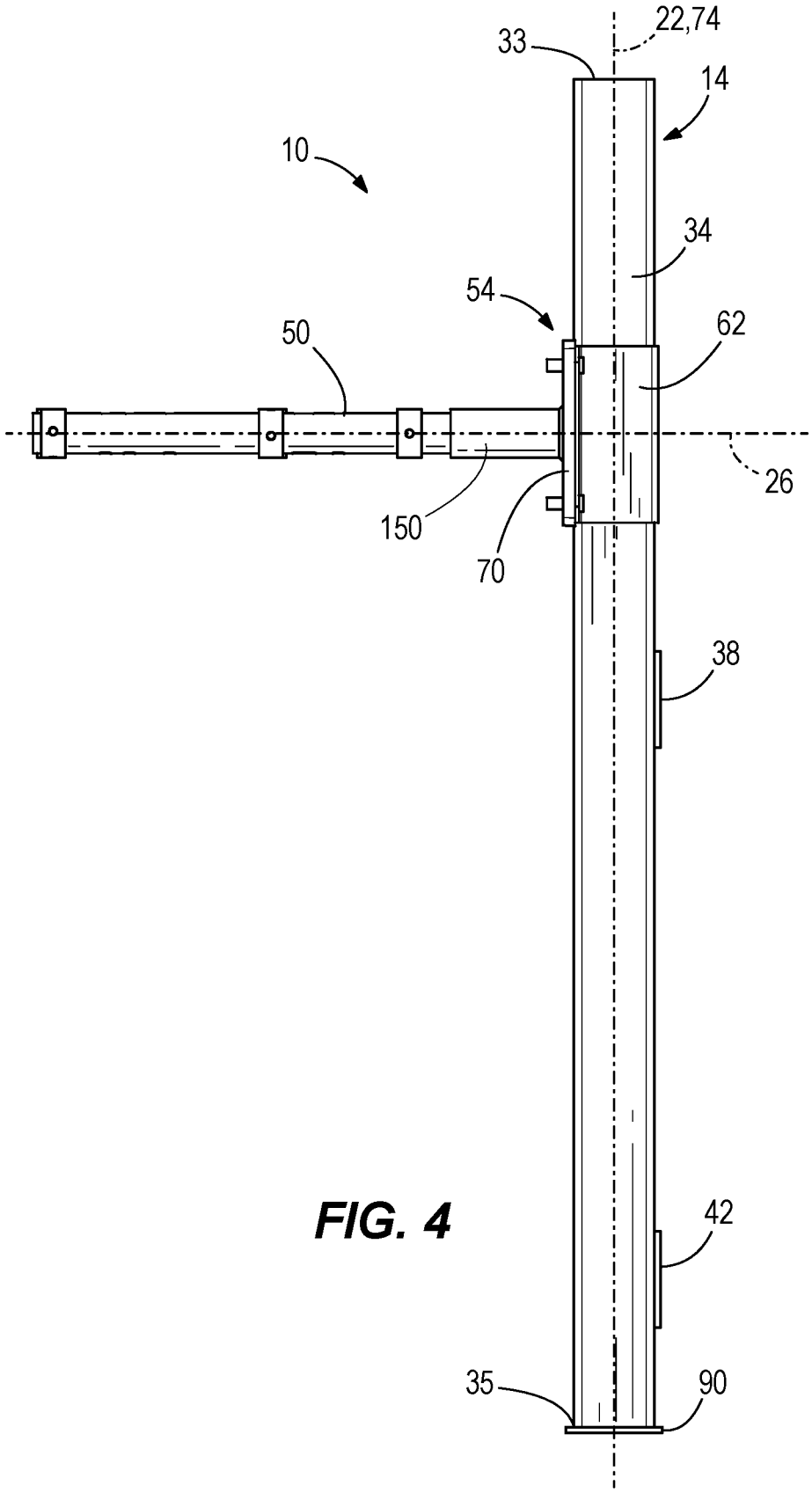
FIG. 4 is a side view of the fixture carrier of FIG. 1.

Before any embodiments of the disclosure are explained in detail, it is to be understood that the disclosure is not limited in its application to the details of the formation and arrangement of components set forth in the following description or illustrated in the accompanying drawings. The disclosure is capable of supporting other implementations and of being practiced or of being carried out in various ways.

The figures and accompanying description provide adjustable fixture carriers that are configured to accommodate various sized plumbing fixtures, such as service sinks, lavatories, urinals, water coolers, etc. The adjustable fixture carriers also incorporate simplified structures to provide labor and installation cost savings.

FIGS. 1-4 illustrate a fixture carrier 10 according to an embodiment of the present disclosure. The fixture carrier 10 includes a frame 14, which is adjustable in order to accommodate plumbing fixtures of various sizes. Specifically, the frame 14 is adjustable in a horizontal direction and a vertical direction. The horizontal direction is a direction extending along an X-axis 18, and the vertical direction is a direction extending along a Y-axis 22. The frame 14 is also adjustable in a direction extending along a Z-axis 26.

With reference to FIGS. 1-4, the frame 14 includes a first upright 30, a second upright 34 horizontally spaced a distance from the first upright 30, a first, or upper, cross-bar 38, and a second, or lower, cross-bar 42. The first cross-bar 38 is secured to the first upright 30 and the second upright 34. Similarly, the second cross-bar 42 is secured to the first upright 30 and the second upright 34. The frame 14 additionally includes a first arm 46 and a second arm 50 configured to support the fixture being installed. The first arm 46 is adjustably coupled to the first upright 30 with a first coupling mechanism 54. The first coupling mechanism 54 includes a first bracket 58 and a first plate 66. The second arm 50 is adjustably coupled to the second upright 34 with a second coupling mechanism 56. The second coupling mechanism 56 includes a second bracket 62 and a second plate 70.

The first upright 30 and the second upright 34 are substantially identical, elongate beams. The first upright 30 includes a first end 33 and an opposite second end 35. The second upright 34 includes a first end 29 and an opposite second end 31. Each of the uprights 30, 34 additionally include a foot 90 positioned on the second end 31, 35 of each of the uprights 30, 34. The feet 90 are substantially rectangular plates configured to engage a work surface and support the fixture carrier 10 during use.

Each of the cross-bars 38, 42 are rectangular and planar. The first cross-bar 38 extends between and is coupled to the first and second uprights 30, 34. The first cross-bar 38 includes a first end 37 coupled to the first upright 30 and a second end 39 coupled to the second upright 34. The second cross-bar 42 also extends between and is coupled to the first and second uprights 30, 34. The second cross-bar 42 includes a first end 41 coupled to the first upright 30 and a second end 43 coupled to the second upright 34. The first cross-bar 38 is coupled to the uprights 30, 34 closer to the first ends 29, 33 of the uprights 30, 34, and the second cross-bar 42 is coupled to the uprights 30, 34 closer to the second ends 31, 35 of the uprights 30, 34.

The first and second brackets 58, 62 are removably coupled to the uprights 30, 34 and vertically moveable to a position between the first end 29, 33 of the uprights 30, 34 and the first cross-bar 38. Specifically, the first bracket 58 is coupled to the first upright 30 and the second bracket 62 is coupled to the second upright 34. Each of the brackets 58, 62 are U-shaped and include studs # for securing the brackets 58, 62 to the plates 66, 70. When positioning the bracket 58, 62 on the upright 30, 34, the user may slide the bracket 58, 62 along the longitudinal axis 74 to a desired position. Then, the user may insert a fastener into the brackets 58, 62, thereby securing the brackets 58, 62 against the uprights 30, 34 and preventing movement of the brackets 58, 62 in either a horizontal or vertical direction.

With continued reference to FIGS. 1-4, the first plate 66 is positioned between the first bracket 58 and the first arm 46. The second plate 70 is positioned between the second bracket 62 and the second arm 50. The plates 66, 70 are rectangular in shape. The plates 66, 70 include a first elongated slot 142 and a second elongated slot 146 extending through the thickness of the plate. The first slot 142 is positioned near the top edge 126 of the plate. The first slot 142 is parallel to the top and bottom edges 126, 130. Similarly, the second slot 146 is positioned near the bottom edge 130 of the plate. The second slot 146 is parallel to the top and bottom edges 126, 130 and to the first slot 142. The first and second slots 142, 146 are shaped and sized to receive the studs 118 of the bracket 58, 62. During installation of the plates 66, 70 onto the brackets 58, 62, a user may position the plates 66, 70 against the brackets 58, 62, thereby allowing the studs 118 to protrude through the first and second slots 142, 146. In order to move the plates 66, 70 to the desired position, the user may slide the plates 66, 70 in the horizontal direction. As the plates 66, 70 slide, the studs 118 slide along the first and second slots 142, 146. The user may secure the position of the plates 66, 70 relative to the brackets 58, 62 by securing a fastener to the studs 118. With continued reference to FIGS. 1-4, each plate 66, 70 includes a receptacle 150 extending from a front face of the plates 66, 70. As illustrated, the receptacle has a circular cross-section, however other cross-sections may also be implemented. The plates 66, 70 are independently movable relative to each other. The receptacles 150 additionally include an inner surface having threads. Specifically, each of the receptacles 150 are sized to receive and secure the arms 46, 50 to the plates 66, 70. During installation of the fixture carrier 10, the arms 46, 50 may be secured to the receptacles 150 such that the arms 46, 50 are axially movable with the plates 66, 70 in the horizontal direction.

Figure 5A:
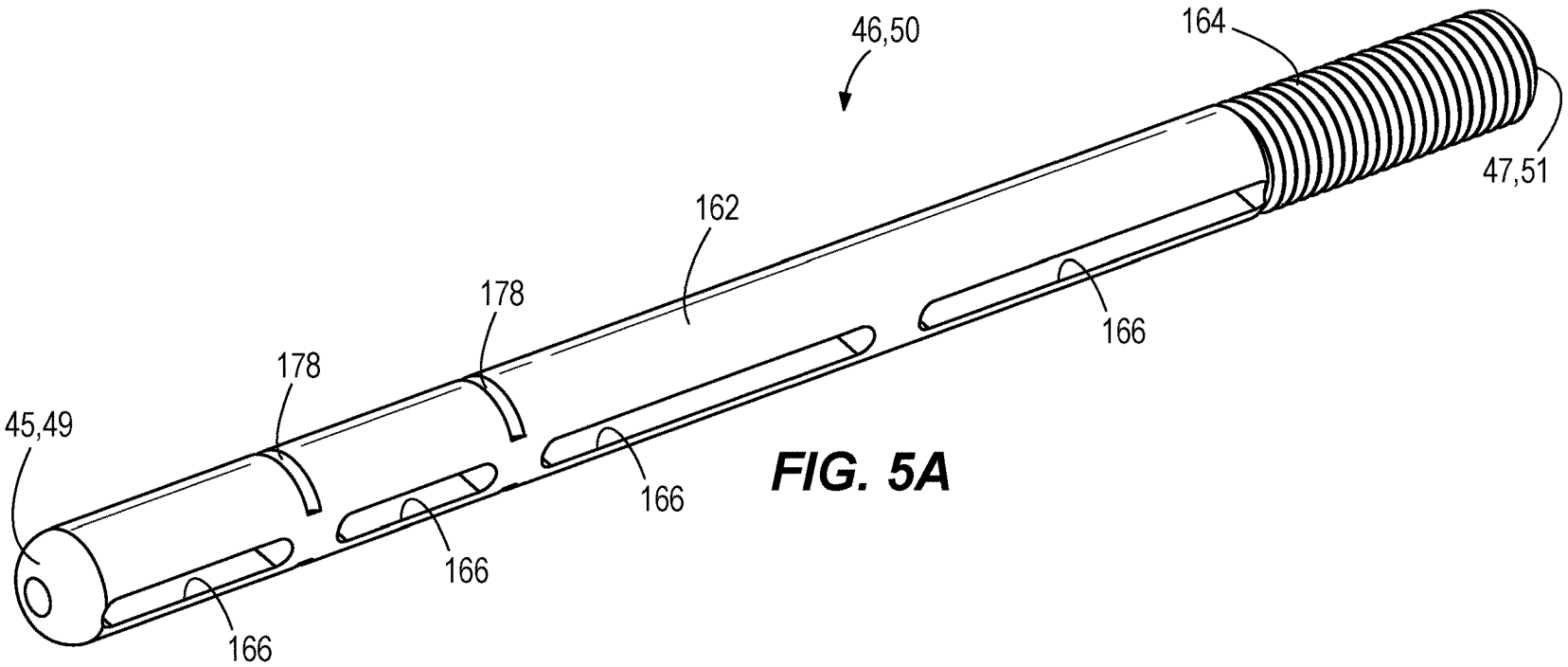
FIG. 5A is a perspective view of an arm of the fixture carrier of FIG. 1.
Figure 5B:
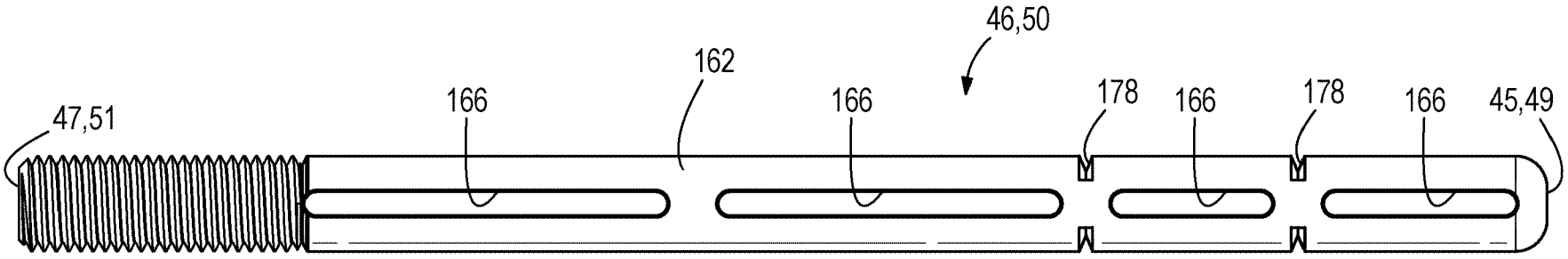
FIG. 5B is a side view of the arm of FIG. 5A.

The arms 46, 50 extend from the frame 14 to support a plumbing fixture during use. With reference to FIG. 5A-5B, the first and second arms 46, 50 include a body 162 and elongated slots 166 extending into the body 162. The body 162 is cylindrical in cross-section and includes a first end 45, 49, and a second end 47, 51 opposite the first ends 45, 49. The first ends 45, 49 of the arms 46, 50 extend outward from the frame 14 and the second ends 47, 51 of the arms 46, 50 are secured to the receptacles 150 of the plates 66, 70. The second ends 47, 51 of the arms 46, 50 include threads 164 corresponding to the threads positioned on the inner surfaces 158 the receptacles 150. Therefore, each of the arms 46, 50 are threadably coupled to the receptacles 150. In alternative embodiments, the arms 46, 50 may be threaded along the length or partial length of the body 162. In alternative embodiments, the arm 46, 50 may be secured to the receptacle 150 via several fasteners (e.g., threaded fasteners). Specifically, the receptacle 150 includes various threaded apertures equidistantly spaced around the perimeter of the receptacle 150. After the arm 46, 50 is positioned within the receptacle 150, the fasteners are threaded into the apertures and into abutment with the arm 46, 50. The fasteners may be continually threaded until there is a snug connection between the fasteners and the arm 46, 50, thereby inhibiting the arm 46, 50 from moving.

In the illustrated embodiments, the slots 166 are elongate apertures, which extend through the arm 46, 50. In some embodiments, the slots 166 may extend along the length of the body 162 or include alternative shapes and sizes. In such instances, the body 162 may include one or several slots 166. In some constructions, the slot(s) 166 are recessed within the body 162 and do not extend completely through the body 162.

The arms further include sleeves 174 (FIGS. 1-2 and 4) supported by the arms 46, 50 and movable (e.g., slidable) along the arms 46, 50 in a direction parallel to the Z-axis 26. In some embodiments, the sleeves 174 may also or alternatively rotate relative to the arms 46, 50. Each of the sleeves 174 include a body having an outer surface configured to be engaged by the user to move the sleeve relative to the arms 46, 50. In the illustrated embodiments, each of the sleeves 174 are secured to the arms via pins or set screws. Each of the sleeves 174 includes an aperture extending through the sleeve 174. The sleeve apertures and the slots of the body are shaped and sized to receive the pin or set screw. The pin extends through the sleeve aperture and the slot to secure the sleeve in a specific position on the arms 46, 50.

The pins are slidable along the length of the slot 166, such that movement of the pin axially repositions the sleeve relative to the body 162. Specifically, a user may slide the pin to a position such that it aligns with a corresponding aperture on a plumbing fixture. A user may secure the pin and the sleeve in a desired position via a fastener (e.g., a screw and/or a lock down). The pin may then protrude through the corresponding aperture on the plumbing fixture and support the fixture during use. As such, the sleeves and pins may be repositioned in a direction parallel to the Z-axis 26 to align with plumbing fixtures of various lengths. In some embodiments, the pins may be placed directly within the slots 166, without the use of the sleeves.

In alternative embodiments, the pin may be a cotter pin, or alternative type of fastener. In still further embodiments, the pin may be a bolt. In such instances, the bolt may be tightened to secure the arm 46, 50 to the sleeve and/or to secure the arm 46, 50 to the receptacle 150. In still further embodiments, the pin may be a spring-loaded actuator. In such instances, the actuator is positioned within the slot 166 on the arm 46, 50. A spring biases the actuator upwards through the slot 166 and the sleeve aperture, thereby preventing movement of the sleeve relative to the arm 46, 50.

With continued reference to FIGS. 5A-5B, the first and second arms 46, 50 additionally include notches 178 extending at least partially around a circumference of the body 162. The notches 178 are recessed grooves extending into the body 162 of the arm 46, 50 and form "cut-off" points in the arms 46, 50. In other words, in the event that the user requires a shorter arm, the user may break the arm 46, 50 at one of the notches 178, thereby creating a shorter arm. In the illustrated embodiments, the arms 46, 50 include two notches 178. However, in alternative embodiments, the arms may include fewer or more notches.

The fixture carrier 10 is used to support a plumbing fixture being installed in a structure. The fixture carrier 10 may be adjusted to support different fixtures of various sizes. The position of the sleeves 170 may be adjusted relative to the arms 46, 50 in order to accommodate fixtures of various depths. Specifically, the user may slide each of the sleeves 170 along the arm 46, 50 and align the sleeve aperture with the slots 166 of the body 162. The user may then insert the pin through the aperture and the slot 166 and secure the positioning of the pin by inserting a fastener. The plumbing fixture may be placed on the frame 14 for support.

FIGS. 6A-22B illustrate alternative arms for use with the fixture carrier 10. The illustrated arms are similar to the arms 46, 50 described above and include like parts. Reference is hereby made to the description of the fixture carrier 10 and arms 46, 50 shown in FIGS. 1-5B for description of features and elements of the arms not included below.

FIGS. 6A-7B illustrate another embodiment of an arm 46*a*, with like components designated with an "a." The arm 46*a* is largely identical to the arms 46, 50, with some differences, as described below.

Figure 6A:
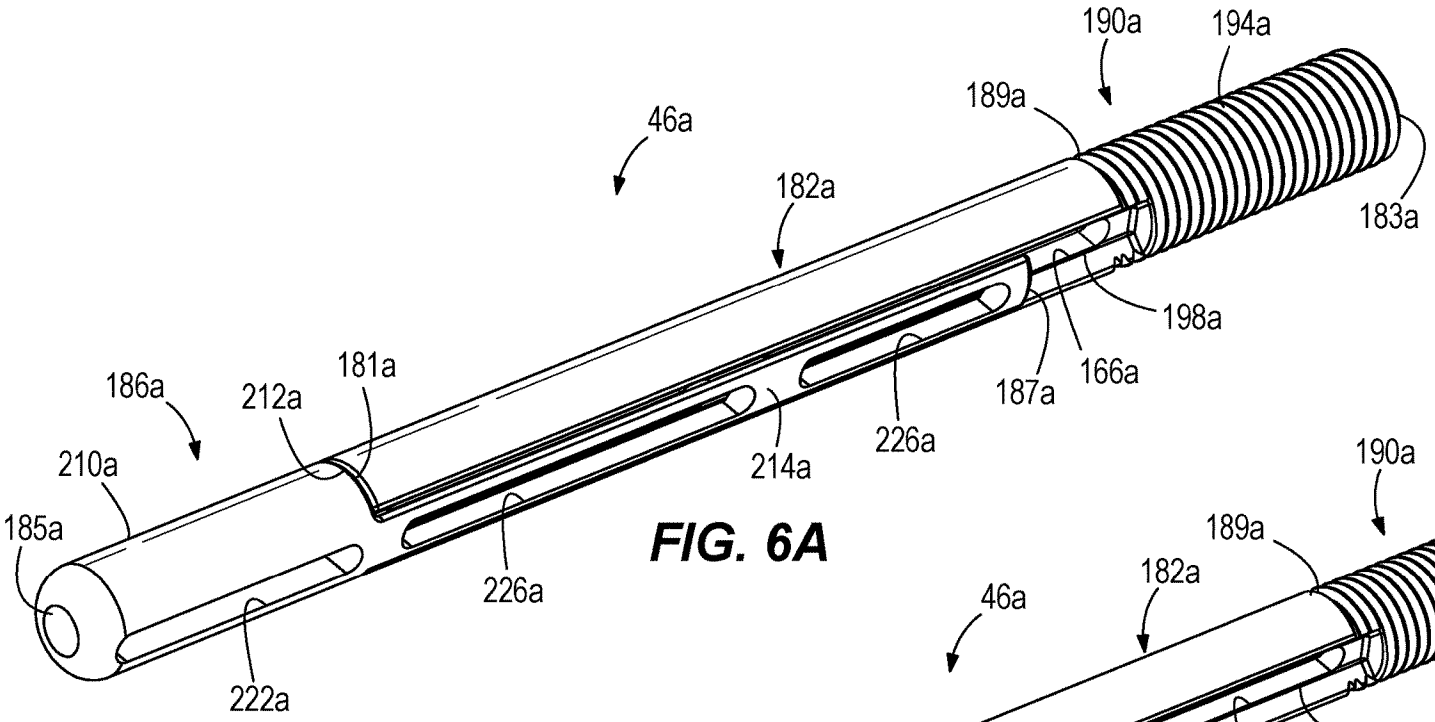
FIG. 6A is a perspective view of an alternative arm for use with the fixture carrier of FIG. 1 in a retracted position.
Figure 6B:
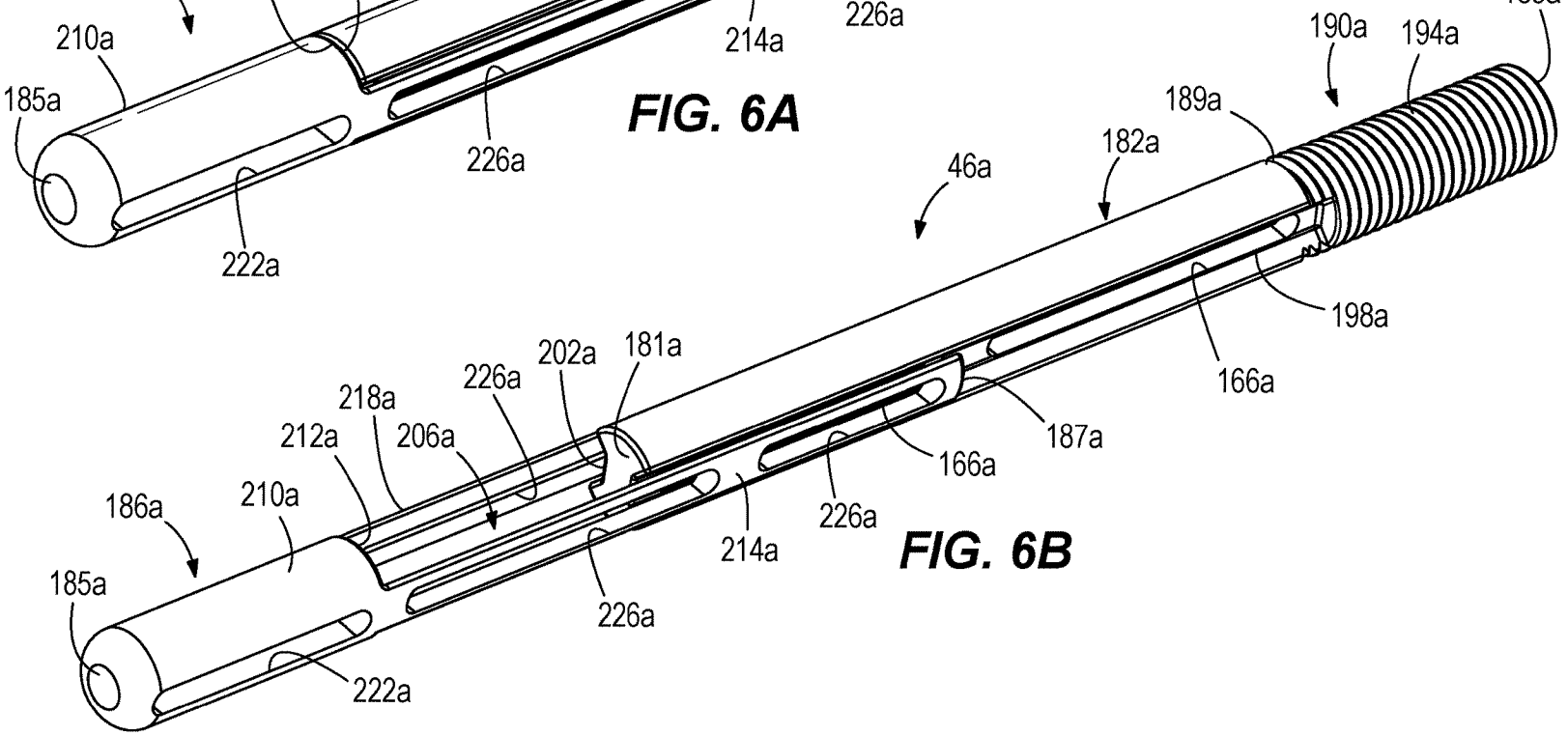
FIG. 6B is a perspective view of the arm of FIG. 6A in an extended position.

With reference to FIGS. 6A-6B, the arm 46*a* is cylindrical in cross-section. The arm 46*a* additionally includes a stationary base 182*a* and an extension 186*a*, which is movable relative to the base 182*a*. The base 182*a* includes a first end 181*a*, and a second end 183*a* opposite the first end 181*a*. The first end 181*a* extends outward from the frame 14, and the second end 183*a* of the arm 46*a* is secured to the receptacle 150 of the plate 66, 70. The second end 183*a* includes a connection portion 190*a* having threads 194*a* corresponding to the threads positioned on the inner surface of the receptacle 150. Therefore, the connection portion 190*a* of the arm 46*a* is threadably coupled to the receptacle 150. In alternative embodiments, the base 182*a* may be threaded along the length or partial length of the base 182*a*. In alternative embodiments, the arm 46*a* may be secured to the receptacle 150 via fasteners.

The base 182*a* additionally includes a first channel 198*a* and a second channel 202*a* extending from the first end 181*a* of the base 182*a* to a first end 189*a* of the connection portion 190*a*. The first channel 198*a* and the second channel 202*a* are U-shaped, and the first channel 198*a* is positioned on an opposite side of the base 182*a* as the second channel 202*a*. The base 182*a* includes elongate slots 166*a* extending through the base 182*a*. The slots 166*a* are elongate apertures, which extend along substantially the entire non-threaded portion of the base 182*a*. However, in alternative embodiments, the slots 166*a* may extend along a shorter or longer portion of the base 182*a*. In some constructions, the slot(s) 166*a* are recessed within the base 182*a* and do not extend completely through the base 182*a*. In the illustrated embodiments, the base 182*a* includes two slots 166*a*. However, in alternative embodiments, the base 182*a* may include fewer or more slots.

The extension 186*a* includes a first end 185*a*, and a second end 187*a* opposite the first end 185*a*. The extension 186*a* is cylindrical and includes a cut-out 206*a* extending from the second end 187*a* of the extension 186*a* through a portion of the extension 186*a*. The cut-out 206*a* forms a solid portion 210*a*, a first elongate arm 214*a*, and a second elongate arm 218*a*. The elongate arms 214*a*, 218*a* extend from the solid portion 210*a*. The solid portion 210*a* includes an elongate slot 218*a*, or aperture, extending through the extension 186*a*. In the illustrated embodiments the solid portion 210*a* includes one slot 222*a*. However, in alternative embodiments, the solid portion 210*a* may include fewer or more slots. The arms 214*a*, 218*a* extend from the solid portion 210*a* and are oriented parallel to each other and on opposite sides of the extension 186*a*. The arms 214*a*, 218*a* are shaped and sized to be received within the first channel 198*a* and the second channel 202*a* of the base 182*a*. The arms 214*a*, 218*a* include elongate slots 226*a*, or apertures, extending through the extension 186*a*. In the illustrated embodiments, the arms 214*a*, 218*a* include two elongate slots 226*a*. However, in alternative embodiments, the arms 214*a*, 218*a* may include fewer or more slots.

The arm 46*a* may additionally or alternatively include a sleeve, or collar, (not shown) supported by the arm 46*a* movable (e.g., slidable) along the arm 46*a*. The sleeve includes an outer surface engageable by the user to move the sleeve relative to the arm 46*a*. Specifically, the sleeve may be two washers secured together via a fastener (e.g., a bolt, etc.). The sleeve clamps around the arm 46*a* in order to secure the extension 186*a* to the base 182*a* in a given position. In some embodiments, the sleeve includes apertures extending through the sleeve. The apertures, the slots 166*a* on the base 182*a*, and the slots 222*a*, 226*a* on the extension 186*a* are shaped and sized to fasteners (e.g., pins).

In order to position the arm 46*a* during operation, the user secures the arm 46*a* to the plumbing fixture by threading the connection portion 190*a* of the base 182*a* into the receptacle 150. The user then positions the extension 186*a* relative to the base 182*a*. Specifically, the user slides the extension 186*a* along the base 182*a*, causing the arms 214*a*, 218*a* to slide along the first and second channels 198*a*, 202*a* of the base 182*a*. The extension 186*a* may be coupled to the base 182*a* in a retracted position (FIG. 6A), in which the first end 181*a* of the base 182*a* abuts an end 212*a* of the solid portion 210*a*, a fully extended position, in which the first end 181*a* of the base 182*a* is positioned adjacent the second end 187*a* of the extension 186*a*, or a plurality of partially extended positions (FIG. 6B) between the retracted position and the fully extended position. In order to couple the extension 186*a* to the base 182*a* in a given position, the user secures the clamp around the extension 186*a* and the base 182*a*. In the retracted position, the slots 166*a* on the base 182*a* are aligned with the slots 226*a* of the arms 214*a*, 218*a*. The user positions fasteners (e.g., pins) through the slots 166*a*, 222*a*, 226*a*. The fasteners protrude through corresponding apertures on the plumbing fixture during use, securing the arm 46*a* to the plumbing fixture.

In some embodiments (FIGS. 7A-7B), the extension 186*a* may include projections 230*a* positioned on the end 212*a* of the solid portion 210*a* of the extension 186*a*, between the arms 214*a*, 218*a*, to provide an additional or alternative means of securing the extension 186*a* to the base 182*a*. Specifically, the extension 186*a* includes two projections 230*a*, such that the projections 230*a* are oriented parallel to each other and on opposite sides of the end 212*a* of the solid portion 210*a* of the extension 186*a*. The projections 230*a* include a cylindrical aperture 234*a* sized to receive a fastener. In some embodiments, the apertures 234*a* may include alternative shapes.

Figure 7A:
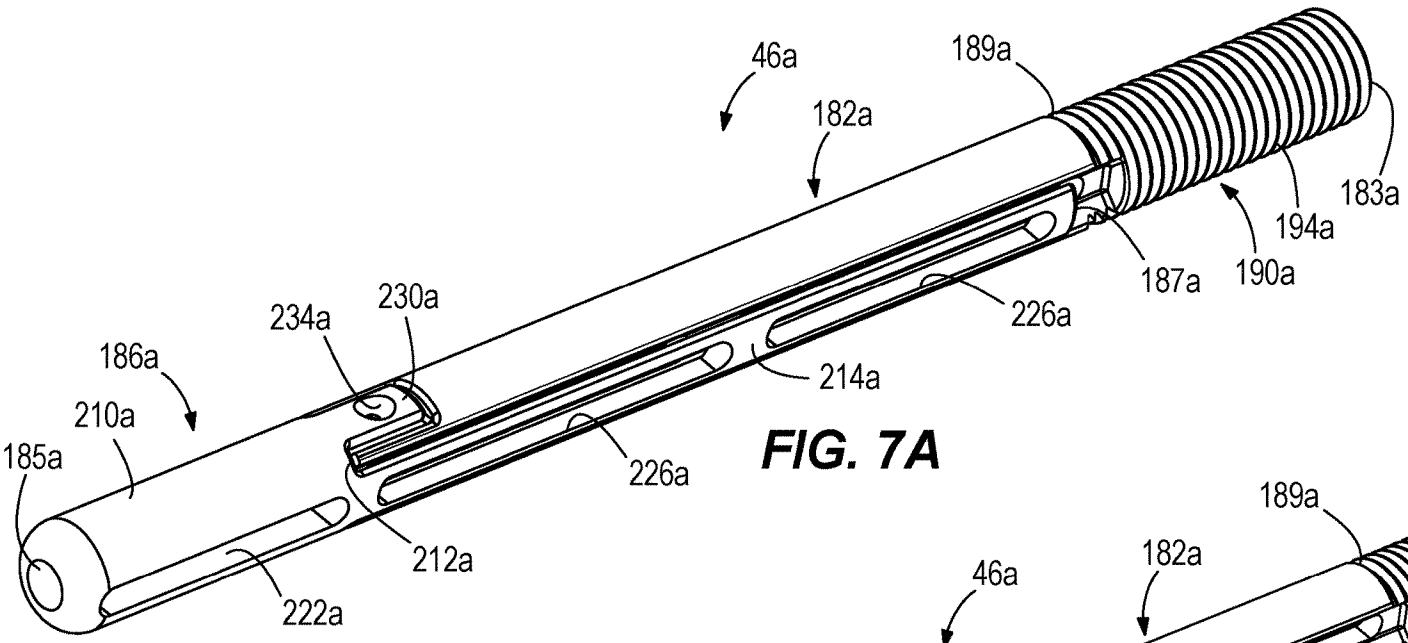
FIG. 7A is a perspective view of an alternative arm for use with the fixture carrier of FIG. 1 in a retracted position.
Figure 7B:
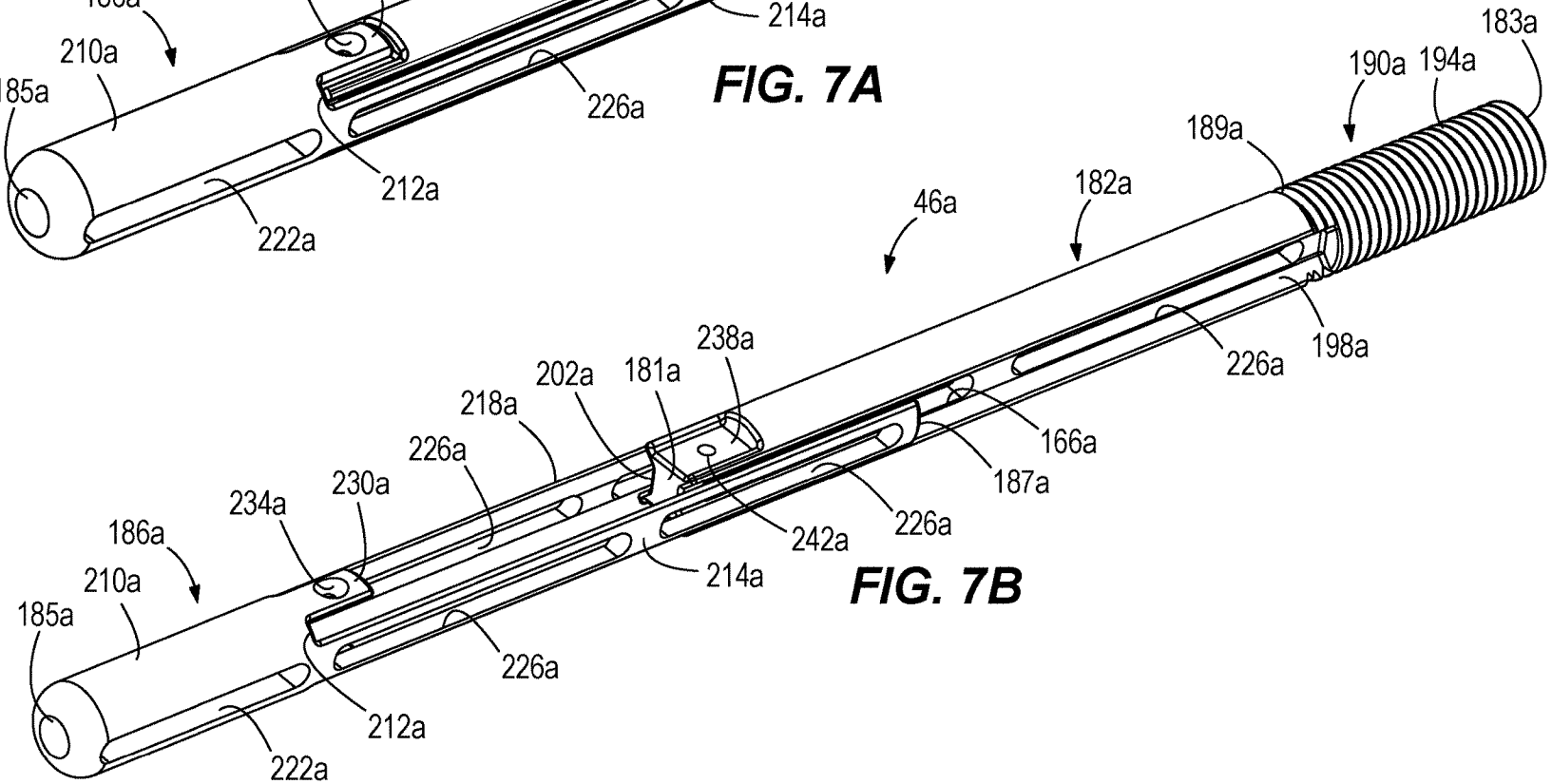
FIG. 7B is a perspective view of the arm of FIG. 7A in an extended position.

In the illustrated embodiments, as shown in FIGS. 7A-7B, the base 182*a* additionally includes grooves 238*a* positioned on the first end 181*a* of the base 182*a*, between the channels 198*a*, 202*a*. Specifically, the base 182*a* includes two grooves 238*a*, such that the grooves 238*a* are oriented parallel to each other and on opposite sides of the first end 181*a* of the base 182*a*. The grooves 238*a* are shaped and sized to receive the projections 230*a*. The grooves 238*a* include a cylindrical aperture 242*a* sized to receive a fastener. Specifically, the apertures 242*a* have a shape and size corresponding to the cylindrical apertures 234*a* positioned on the projections 230*a*.

When the extension 186*a* is coupled to the base 182*a* in the retracted position (FIG. 7A), the projections 230*a* of the extension 186*a* engage the grooves 238*a* of the base 182*a*, aligning the apertures 234*a* on the projections 230*a* with the apertures 242*a* on the grooves 238*a*. The user may then insert fasteners through the apertures 234*a*, 242*a*, thereby securing the extension 186*a* to the base 182*a*.

FIGS. 8A-11B illustrate another embodiment of an arm 46*b*, with like components designated with a "b." The arm 46*b* is largely identical to the arms 46, 50, with some differences, as described below.

Figure 8A:
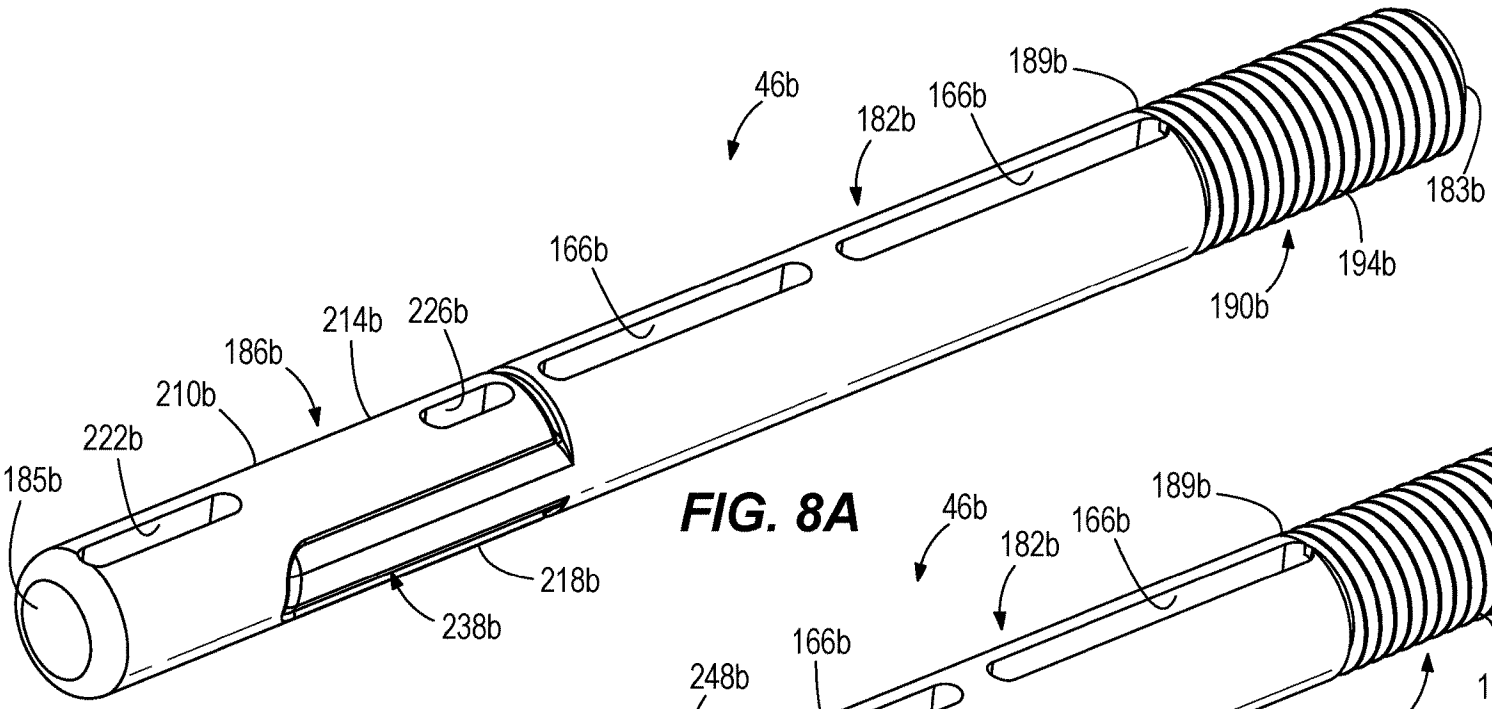
FIG. 8A is a perspective view of an alternative arm for use with the fixture carrier of FIG. 1 in a retracted position.
Figure 8B:
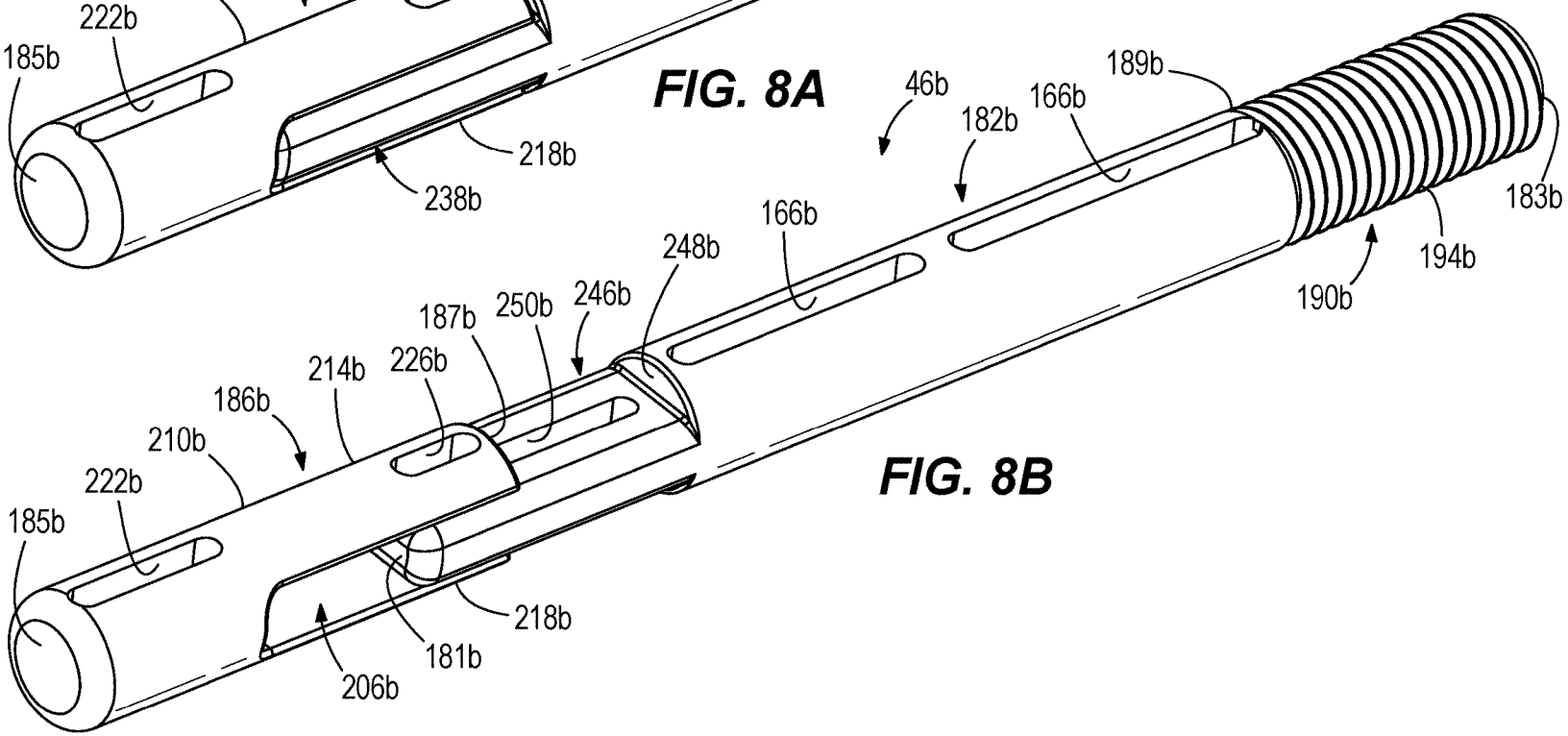
FIG. 8B is a perspective view of the arm of FIG. 8A in an extended position.
Figure 9A:
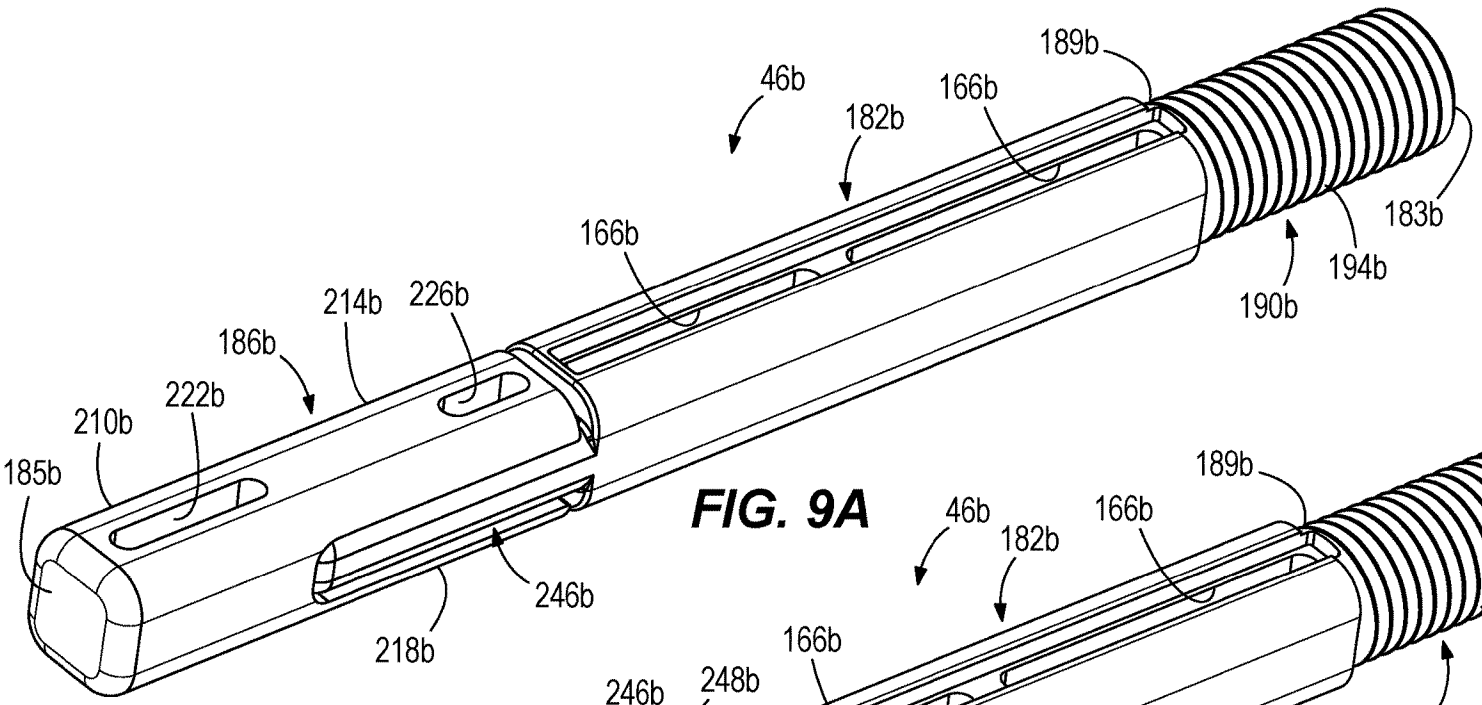
FIG. 9A is a perspective view of an alternative arm for use with the fixture carrier of FIG. 1 in a retracted position.
Figure 9B:
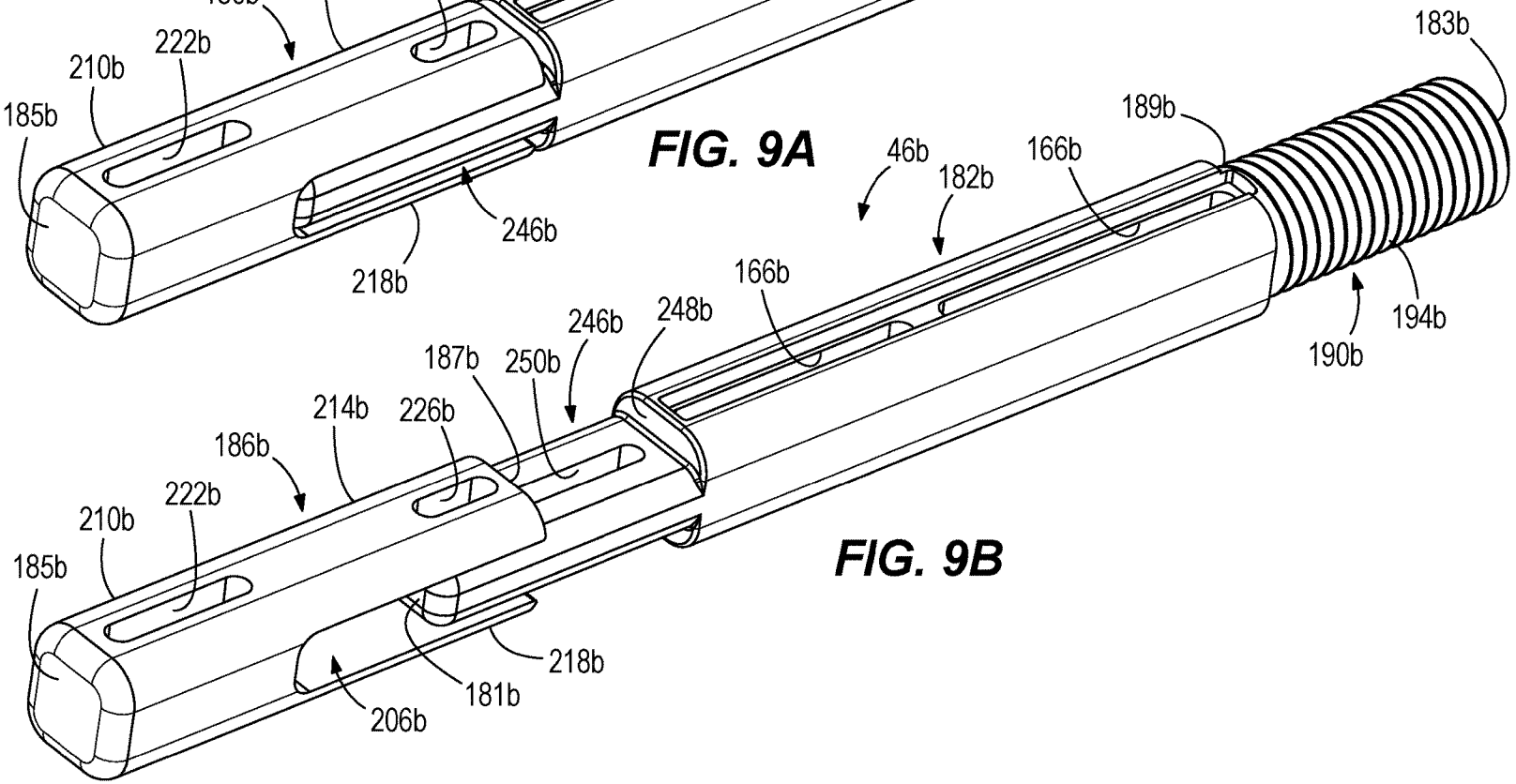
FIG. 9B is a perspective view of the arm of FIG. 9A in an extended position.
Figure 10A:
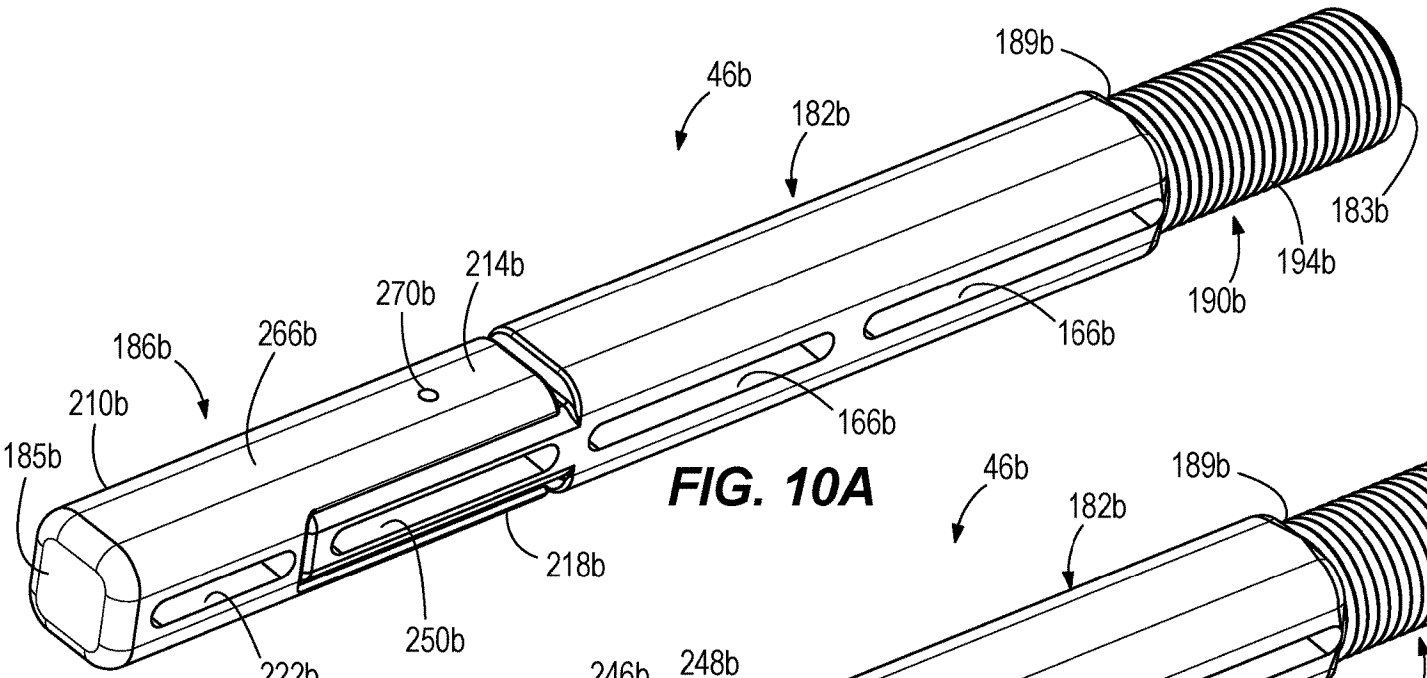
FIG. 10A is a perspective view of an alternative arm for use with the fixture carrier of FIG. 1 in a retracted position.
Figure 10B:
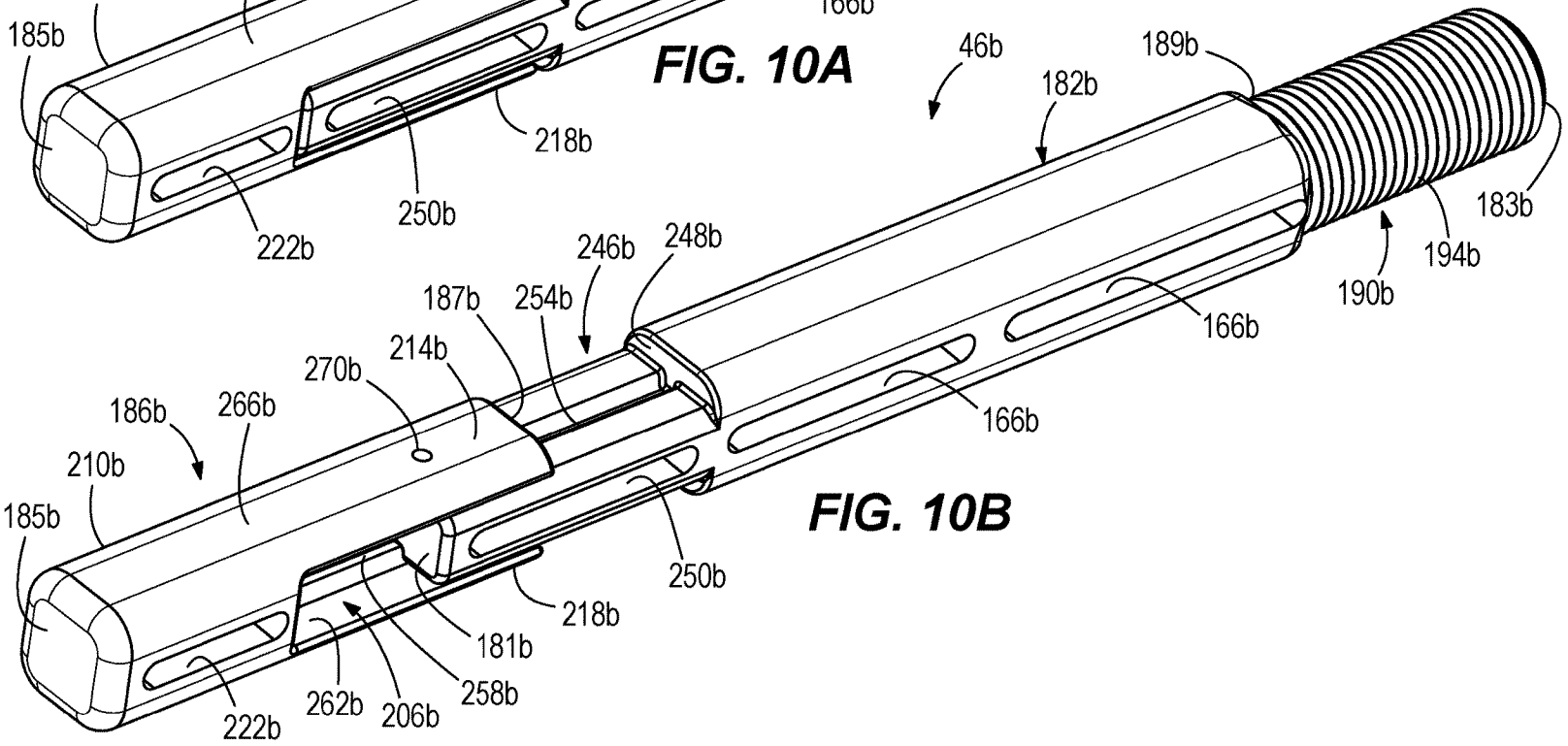
FIG. 10B is a perspective view of the arm of FIG. 10A in an extended position.
Figure 11A:
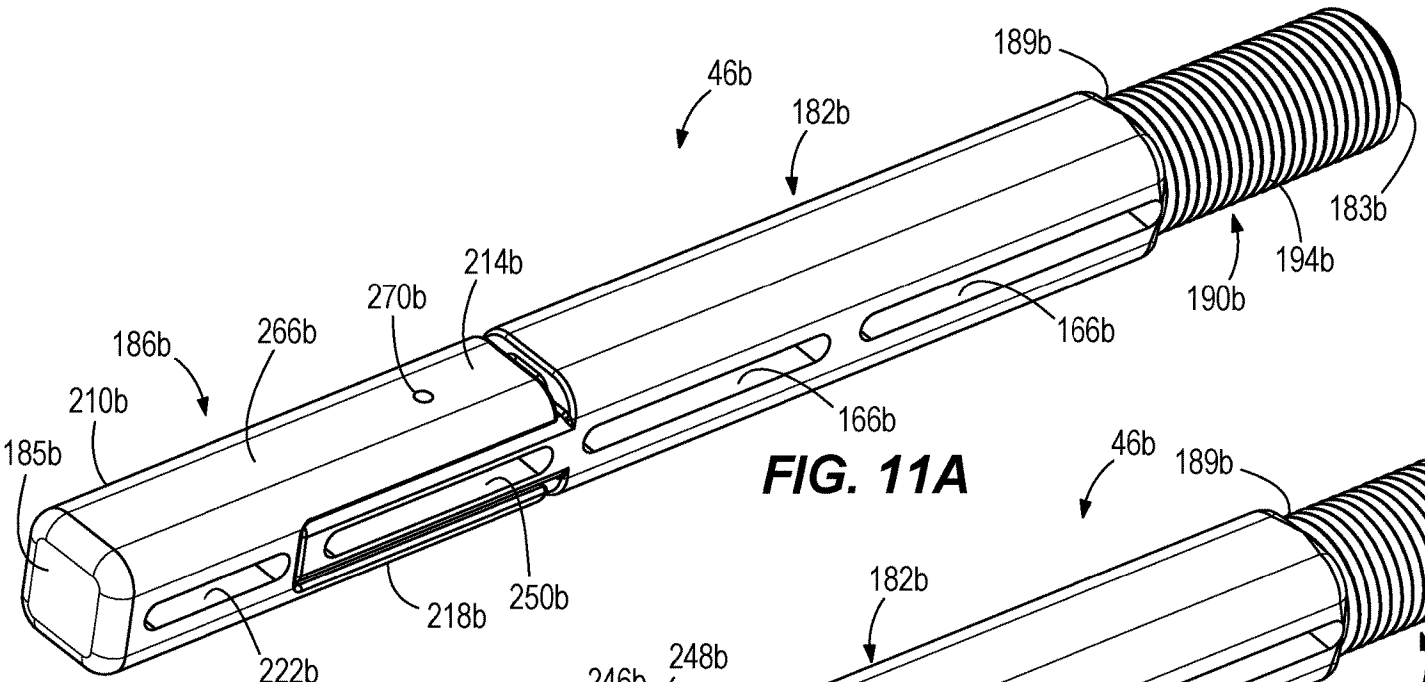
FIG. 11A is a perspective view of an alternative arm for use with the fixture carrier of FIG. 1 in a retracted position.
Figure 11B:
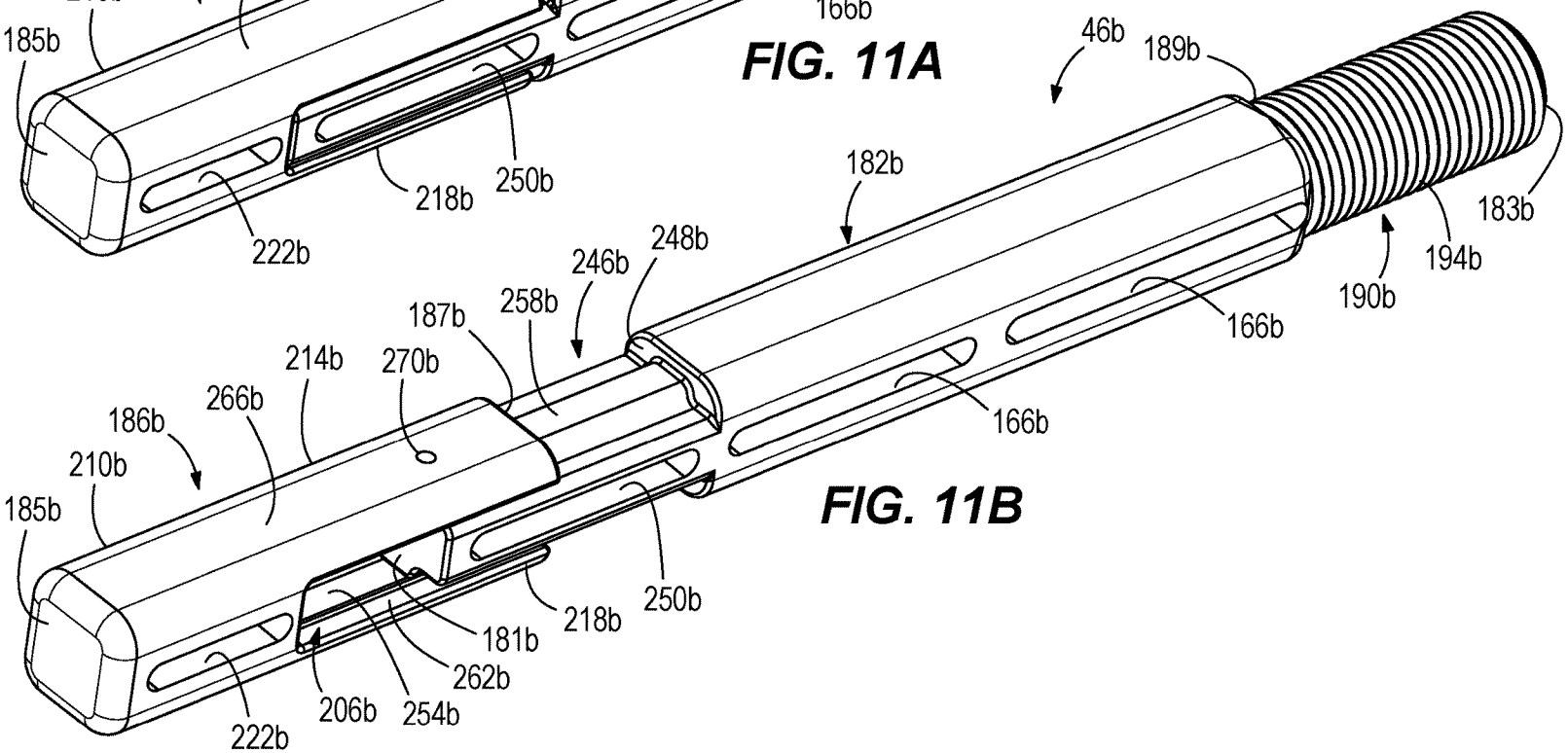
FIG. 11B is a perspective view of the arm of FIG. 11A in an extended position.

With reference to FIGS. 8A-8B, the arm 46*b* is cylindrical in cross-section. The arm 46*b* includes a stationary base 182*b* and an extension 186*b*, which is movable relative to the base 182*b*. The base 182*b* includes a first end 181*b*, and a second end 183*b* opposite the first end 181*b*. The first end 181*b* extends outward from the frame 14 and the second end 183*b* of the arm 46*b* is secured to the receptacle 150 of the plate 66, 70. The second end 183*b* of the base 182*b* includes a connection portion 190*b* having threads 194*b* corresponding to the threads positioned on the inner surface of the receptacle 150. Therefore, the connection portion 190*b* of the arm 46*b* is threadably coupled to the receptacle 150. In alternative embodiments, the arm 46*b* may be threaded along the length of partial length of the base 182*b*. In alternative embodiments, the arm 46*b* may be secured to the receptacle 150 via fasteners.

The first end 181*b* of the base 182*b* includes a rectangular key 246*b*, or keyed portion. The key 246*b* is recessed, such that a circumference of the key 246*b* is less than a circumference of the base 182*b*. The base 182*b* includes elongated slots 166*b*, or apertures, extending through the base 182*b*. In the illustrated embodiments, the base 182*b* includes one slot 166*b* extending along the key 246*b*, and two elongate slots 250*b* extending between the key 246*b* and the connection portion 190*b* of the arm 46*b*. In alternative embodiments, the slots 166*b*, 250*b* may include additional shapes or sizes, and/or extend along a shorter or longer portion of the base 182*b*. In some constructions, the slot(s) 166*b*, 250*b* are recessed within the key 246*b* and/or the arm 46*b* and do not extend completely through the key 246*b* and/or arm 46*b*. Additionally, in alternative embodiments, the base 182*b* may include fewer or more slots.

The extension 186*b* includes a first end 185*b*, and a second end 187*b* opposite the first end 185*b*. The extension 186*b* is cylindrical and includes a cut-out 206*b* extending from the second end 187*b* of the extension 186*b* through a portion of the extension 186*b*. The cut-out 206*b* forms a solid portion 210*b*, a first elongate arm 214*b*, and a second elongate arm 218*b*. The elongate arms 214*b*, 218*b* extend from the solid portion 210*b*. The solid portion 210*b* includes an elongate slot 222*b*, or aperture, extending through the extension 186*b*. In the illustrated embodiments, the solid portion 210*b* includes one slot 222*b*. However, in alternative embodiments, the solid portion 210*b* may include fewer or more slots. The arms 214*b*, 218*b* extend from the solid portion 210*b* and are oriented parallel to each other and on opposite sides of the extension 186*b*. More specifically, the arms 214*b*, 218*b* extend from an upper and lower surface of the solid portion 210*b*. The arms 214*b*, 218*b* are shaped and sized to receive the key 246*b* of the base 182*b*. The arms 214*b*, 218*b* include elongate slots 226*b*, or apertures, extending through the extension 186*b*. In the illustrated embodiments, the arms 214*b*, 218*b* include one elongate slot

226*b*. However, in alternative embodiments, the arms 214*b*, 218*b* may include additional slots.

The arm 46*b* additionally or alternatively includes a sleeve, or collar, (not shown) supported by the arm 46*b* movable (e.g., slidable) along the arm 46*b*. The sleeve includes an outer surface configured to be engaged by the user to move the sleeve relative to the arm 46*b*. Specifically, the sleeve may be two washers secured together via a fastener (e.g., a bolt, etc.). The sleeve clamps around the arm 46*b* in order to secure the extension 186*b* to the base 182*b* in a given position. In some embodiments, the sleeve includes apertures extending through the sleeve. The apertures, the slots on the base, and the slots on the extension are shaped and sized to fasteners (e.g., pins).

In order to position the arm 46*b* during operation, the user secures the arm 46*b* to the fixture by threading the connection portion 190*b* of the base 182*b* into the receptacle 150. The user then positions the extension 186*b* relative to the base 182*b*. Specifically, the user slides the extension 186*b* along the base 182*b*, causing the arms 214*b*, 218*b* to slide along and cover the key 246*b*. The extension 186*b* may be coupled to the base 182*b* in a retracted position (FIG. 8A), in which the first end 181*b* of the base 182*b* abuts an end 248*b* of the key 246*b*, a fully extended position (FIG. 8B), in which the first end 181*b* of the base 182*b* is positioned adjacent the second end 187*b* of the extension 186*b*, or a plurality of partially extended positioned between the retracted position and the fully extended position. In order to couple the extension 186*b* to the base 182*b* in a given position, the user secures the clamp around the extension 186*b* and the base 182*b*. In the retracted position, the slots 166*b* on the base 182*b* are aligned with the slots 226*b* of the arms 214*b*, 218*b*. The user then positions fasteners (e.g., pins) through the slots 166*b*, 226*b*. The fasteners may then protrude through corresponding apertures on the plumbing fixture during use, securing the arm 46*b* to the plumbing fixture.

In some embodiments (FIGS. 9A-9B), the arm may alternatively include a rectangular cross-section. In such embodiments, the base 182*b* and the extension 186*b* each include a rectangular cross-section.

In further embodiments (FIGS. 10A-10B), the key 246*b* includes grooves 254*b* positioned along sides of the key 246*b*. Specifically, the key 246*b* includes two grooves 254*b* oriented parallel to each other on opposite sides of the key 246*b*. The arms 214*b*, 218*b* include corresponding rails 258*b* configured to engage the grooves 254*b*. Specifically, each of the arms 214*b*, 218*b* include a single rail 258*b* extending along an inner surface 262*b* of the arms 214*b*, 218*b*. In such embodiments, the arms 214*b*, 218*b* extend from side surfaces 266*b* of the solid portion 210*b* of the extension 186*b*. Each of the arms 214*b*, 218*b* additionally include a circular aperture 270*b* extending through the extension 186*b*. The circular apertures 186*b* are shaped and sized to receive a fastener. Alternatively, in some embodiments (FIGS. 11A-11B), the rails 258*b* are positioned on sides of the key 246*b* and the corresponding grooves 254*b* are positioned on the inner surfaces 262*b* of the arms 214*b*, 218*b*.

During positioning of the arm 46*b*, the user slides the extension 186*b* along the base 182*b*, causing the arms 214*b*, 218*b* to slide along and cover the key 246*b*. Specifically, the rails 258*b* of the arms 214*b*, 218*b* slide along the grooves 254*b* of the key 246*b*. In order to couple the extension 186*b* to the base 182*b* in a given position, the user positions fasteners (e.g., pins) through the circular apertures 270*b* on the arms 214*b*, 218*b*. The fasteners abut against the grooves 254*b* of the key 246*b*, providing a clamping force against the key 246*b* and securing the extension 186*b* to the base 182*b*.

FIGS. 12A-13B illustrate another embodiment of an arm 46*c*, with like components designated with a "c." The arm 46*c* is largely identical to the arms 46, 50, with some differences, as described below.

Figure 12A:
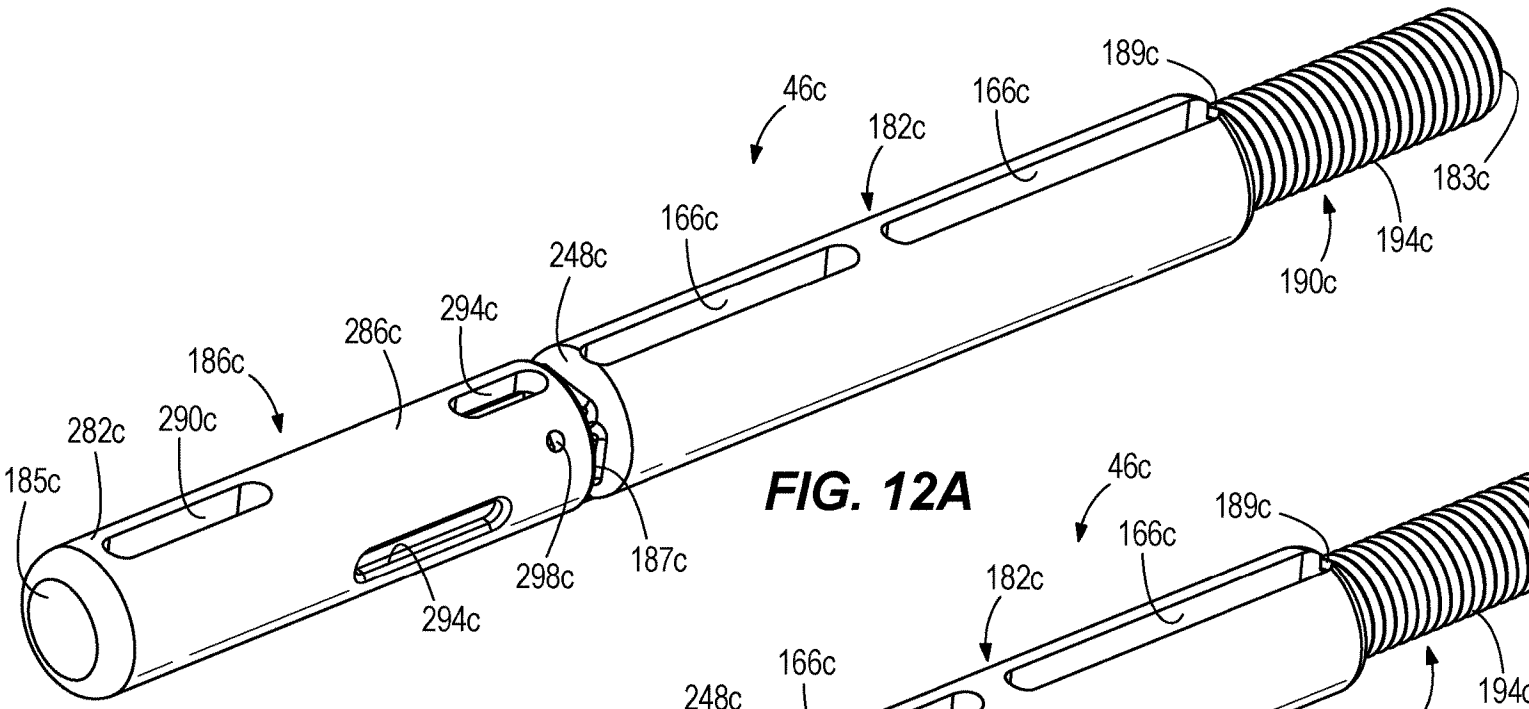
FIG. 12A is a perspective view of an alternative arm for use with the fixture carrier of FIG. 1 in a retracted position.
Figure 12B:
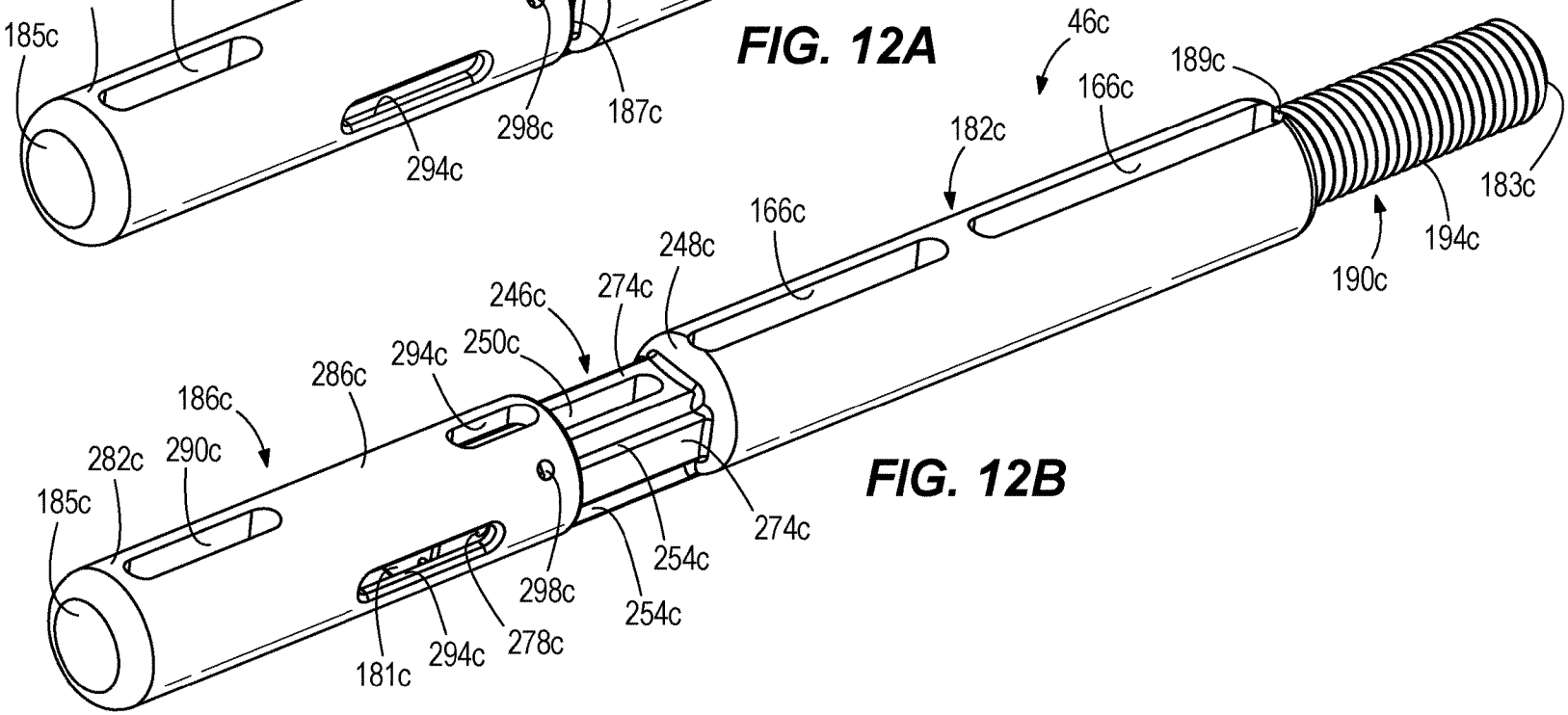
FIG. 12B is a perspective view of the arm of FIG. 12A in an extended position.
Figure 13A:
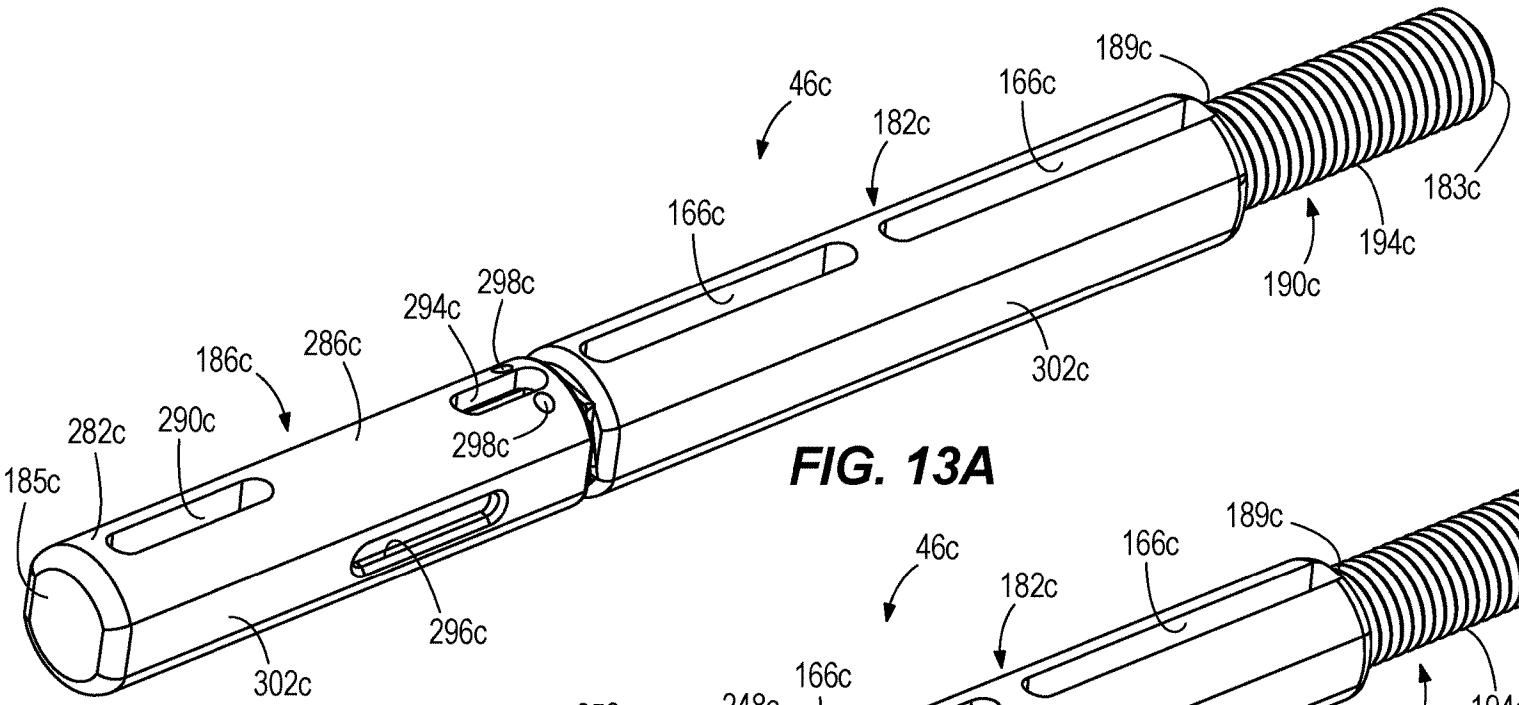
FIG. 13A is a perspective view of an alternative arm for use with the fixture carrier of FIG. 1 in a retracted position.
Figure 13B:
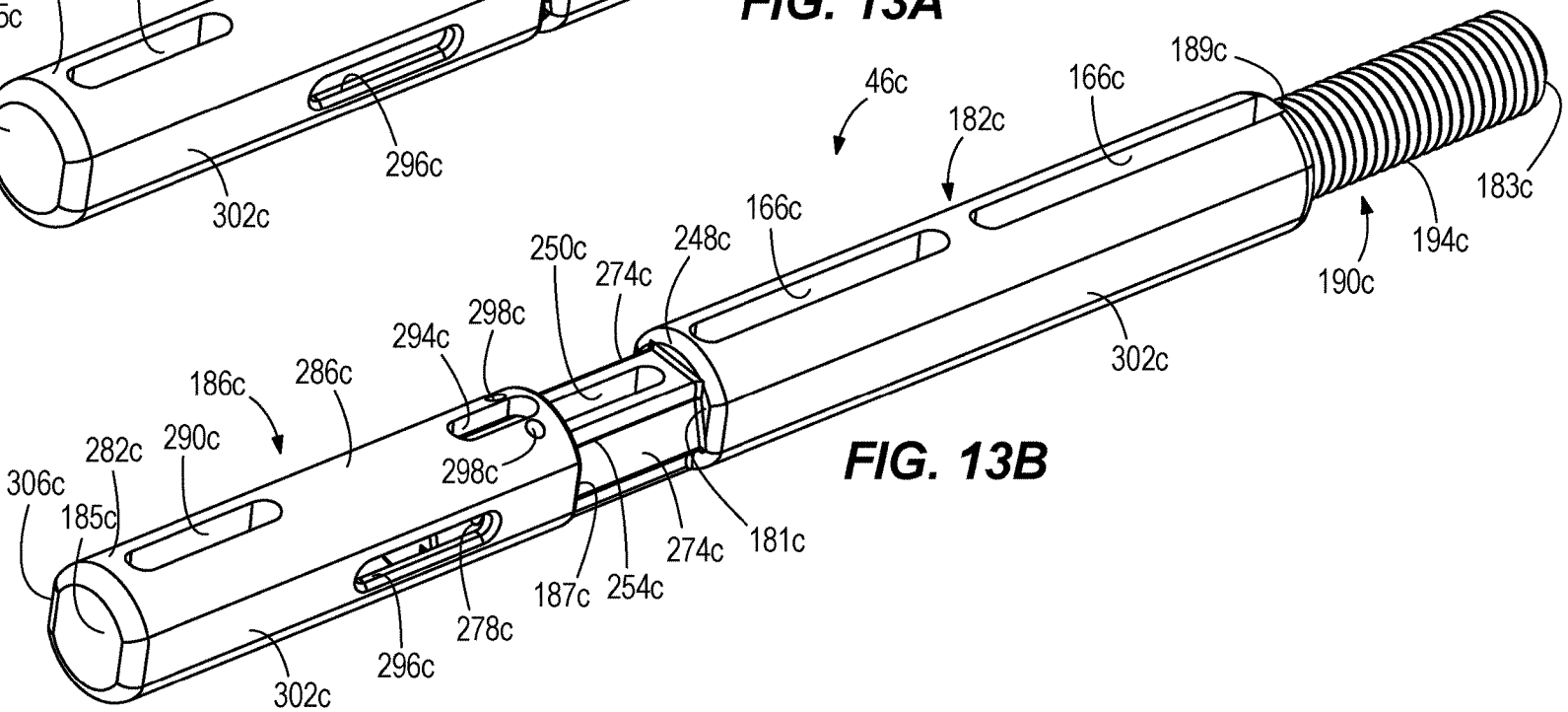
FIG. 13B is a perspective view of the arm of FIG. 13A in an extended position.

With reference to FIG. 12A-12B, the arm 46*c* is cylindrical in cross-section. The arm 46*b* includes a stationary base 182*c* and an extension 186*c*, which is movable relative to the base 182*c*. The base 182*c* includes a first end 181*c*, and a second end 183*c* opposite the first end 181*c*. The first end 181*c* extends outward from the frame 14 and the second end 183*c* of the base 182*c* is secured to the receptacle 150 of the plate 66, 70. The second end 183*c* of the base 182*c* includes a connection portion 190*c* having threads 194*c* corresponding to the threads positioned on the inner surface of the receptacle 150. Therefore, the connection portion 190*c* of the arm 46*c* is threadably coupled to the receptacle 150. In alternative embodiments, the arm 46*c* may be threaded along the length of partial length of the base 182*c*. In alternative embodiments, the arm 46*c* may be secured to the receptacle 150 via fasteners.

The first end 181*c* of the base 182*c* includes a keyed portion 246*c* having grooves 254*c* extending into the base 182*c*. Specifically, the keyed portion 246*c* includes four grooves 254*c*. The grooves 254*c* are equidistantly spaced around the base 182*c* and form four, equidistantly spaced rails 274*c*. An aperture 278*c* extends through the keyed portion 246*c*. Specifically, the aperture 278*c* extends through two of the rails 274*c* and is shaped and sized to receive a fastener.

The base 182*c* includes elongated slots 166*c*, 250*c*, or apertures, extending through the base 182*c*. In the illustrated embodiments, the base 182*c* includes one elongate slot 250*c* extending along the keyed portion 246*c*, and two elongate slots 166*b* extending between the keyed portion 246*c* and the connection portion 190*c* of the arm 46*c*. In alternative embodiments, the slots 166*c*, 250*c* may include additional shapes or sizes, and/or extend along a shorter or longer portion of the base 182*c*. Additionally, in alternative embodiments, the base 182*c* may include fewer or more slots.

The extension 186*c* includes a first end 185*c*, and a second end 187*c* opposite the first end 185*c*. The extension 186*c* is cylindrical and includes a cut-out 206*c* extending from the second end 187*c* of the extension 186*c* through a portion of the extension 186*c*. The cut-out 206*c* forms a solid cylindrical portion 282*c*, and a hollow cylindrical portion 286*c*. The solid cylindrical portion 282 includes an elongate slot 290*c*, or aperture, extending through the extension 186*c*. In the illustrated embodiments, the solid cylindrical portion 282*c* includes one slot 290*c*. However, in alternative embodiments, the solid cylindrical portion 282*c* may include fewer or more slots. An opening (not shown) extends through a portion of the hollow cylindrical portion 286*c*, forming a non-continuous wall (not shown). An internal surface (not shown) of the hollow cylindrical portion 286*c* includes grooves (not shown) extending into the extension 186*c*. The grooves are shaped and sized to receive the corresponding rails 274*c* positioned on the keyed portion 246*c* of the base 182*c*. The hollow cylindrical portion 286*c* includes a first elongate slot 294*c* and a second elongate slot 296*c* extending through the extension 186*c*. The first elongate slot 294*c* extends along an axis parallel to and collinear with an axis of the elongate slot 290*c* of the solid cylindrical portion 282*c*, and the second elongate slot 296*c* extends along an axis parallel to and offset from the axis of the elongate slot 290*c* of the solid cylindrical portion 282*c*. The hollow cylindrical portion 286*c* additionally includes cylindrical apertures 298 extending through the extension 186*c*. In the illustrated embodiments, the hollow cylindrical portion 286*c* includes two elongate slots 294*c*, 296*c* and two cylindrical apertures 298*c*. However, in alternative embodiments, the hollow cylindrical portion 286*c* may include fewer or more slots and/or apertures. The slots 294*c*, 296*c* extend through two of the grooves formed on the inner surface of the hollow cylindrical portion 286*c*.

The arm 46*c* may additionally or alternatively include a sleeve, or collar, (not shown) supported by the arm 46*c* movable (e.g., slidable) along the arm 46*c*. The sleeve includes an outer surface configured to be engaged by the user to move the sleeve relative to the arm 46*c*. Specifically, the sleeve may be two washers secured together via a fastener (e.g., a bolt, etc.). The sleeve clamps around the arm 46*c* in order to secure the extension 186*c* to the base 182*c* in a given position. In some embodiments, the sleeve includes apertures extending through the sleeve. The sleeve apertures, the slots 166*c*, 250*c* on the base 182*c*, and the slots 290*c*, 294*c*, 296*c* on the extension 186*c* are shaped and sized to fasteners (e.g., pins).

In order to position the arm 46*c* during operation, the user secures the arm 46*c* to the fixture by threading the connection portion 190*c* of the base 182*c* into the receptacle 150. The user then positions the extension 186*c* relative to the base 182*c*. Specifically, the user slides the extension 186*c* along the base 182*c*, causing the grooves of the hollow cylindrical portion 286*c* to slide along and cover the rails 274*c* of the keyed portion 246*c*. The extension 186*c* may be coupled to the base 182*c* in a retracted position (FIG. 12A), in which the first end 181*c* of the base 182*c* abuts an end 248*c* of the keyed portion 246*c*, a fully extended position, in which the first end 181*c* of the base 182*c* is positioned adjacent the second end 187*c* of the extension 186*c*, or a plurality of partially extended positions (FIG. 12B) between the retracted position and the fully extended position. In order to couple the extension 186*c* to the base 182*c* in a given position, the user secures the clamp around the extension 186*c* and the base 182*c*. The user may insert fasteners into the apertures 298*c* of the hollow cylindrical portion 286*c*. The fasteners abut against the grooves of the keyed portion 246*c*, providing a clamping force against the keyed portion 246*c* and securing the extension 186*c* to the base 182*c*. Additionally, when the extension 186*c* is in the retracted position, or one of the partially extended positions, the aperture 278*c* of the keyed portion 274*c* aligns with the elongate slots 296*c* of the hollow cylindrical portion 286*c*. The user may insert fasteners through the slots 296*c* and into the apertures 278*c* of the keyed portion 274*c*, thereby securing the extension 186*c* to the base 182*c*.

In order to secure the arm 46 to the plumbing fixture, the user inserts fasteners (e.g., pins) through the elongate slots 166*c* of the base 182*c* and the elongate slot 290*c* of the solid cylindrical portion 282*c* of the extension 186*c*. The fasteners then protrude through corresponding apertures on the plumbing fixture during use, securing the arm 46*c* to the plumbing fixture.

In some embodiments (FIGS. 13A-13B), the arm 46*c* includes flats 302*c*, 306*c* extending along the length of the arm 46*c*. Specifically, the arm 46*c* includes a first flat 302*c* and a second flat 306*c*. The flats 302*c*, 306*c* are positioned on opposite sides of the arm 46*c* and extend parallel to each other. The second elongate slot 296*c* of the hollow cylindrical portion 286*c* is positioned on the first flat 302*c*. In alternative embodiments, the arm 46*c* may include fewer or additional flats extending along the arm.

Figures 14A, 14B:
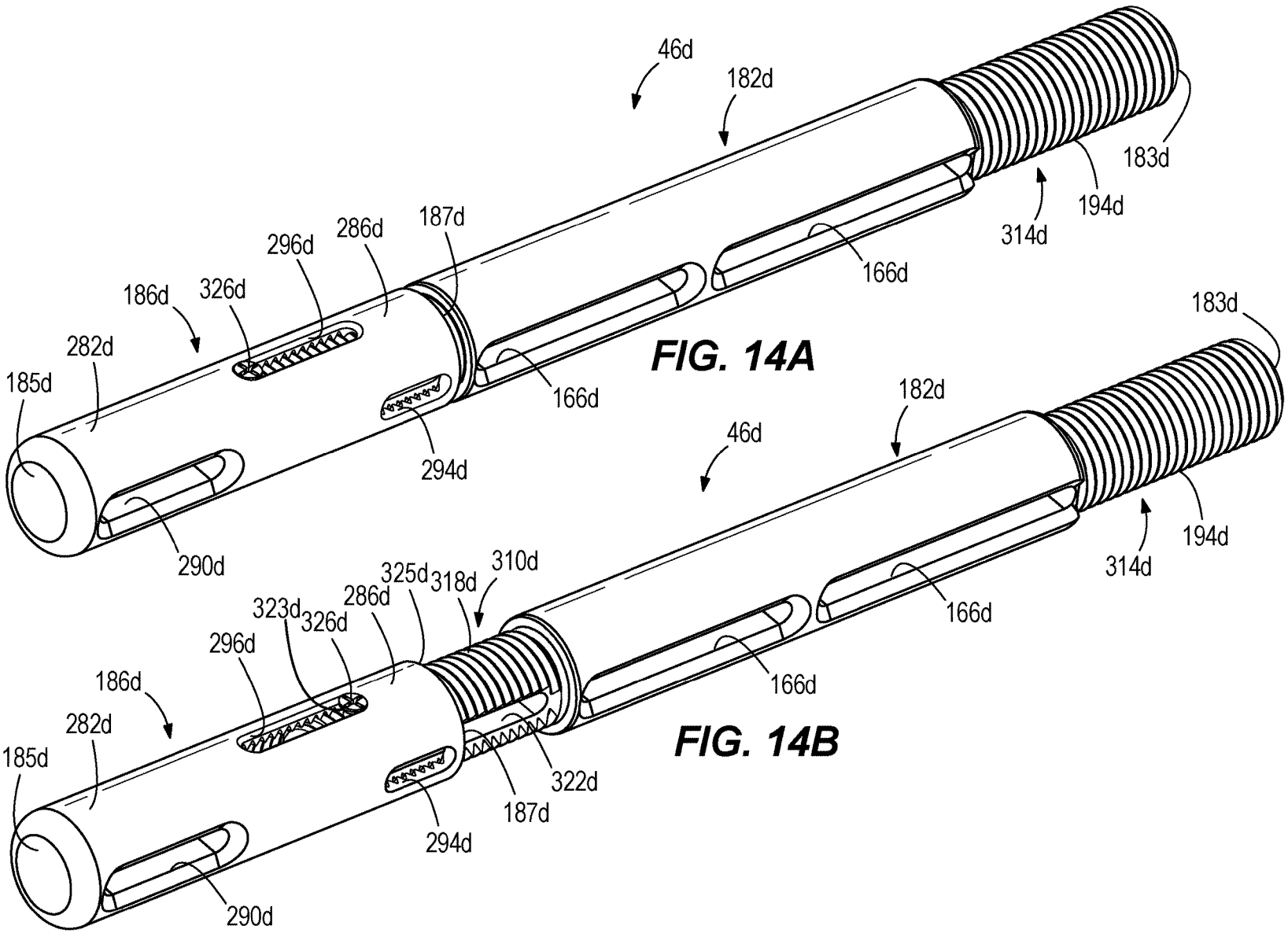
FIG. 14A is a perspective view of an alternative arm for use with the fixture carrier of FIG. 1 in a retracted position.
FIG. 14B is a perspective view of the arm of FIG. 14A in an extended position.

FIGS. 14A-14B illustrate another embodiment of an arm 46*d*, with like components designated with a "d." The arm 46*d* is largely identical to the arms 46, 50, with some differences, as described below.

With reference to FIGS. 14A-14B, the arm 46*d* is cylindrical in cross-section. The arm 46*d* includes a stationary base 182*d* and an extension 186*d*, which is movable relative to the base 182*d*. The base 182*d* includes a first end, and a second end 183*d* opposite the first end. The first end extends outward from the frame 14 and includes a first connection portion 310*d*. The second end 183*d* of the base 182*d* includes a second connection portion 314*d* secured to the receptacle 150 of the plate 66, 70. The second connection portion 314*d* includes threads 194*d* corresponding to the threads positioned on the inner surface of the receptacle 150. Therefore, the second connection portion 314*d* of the arm 46*d* is threadably coupled to the receptacle 150. The first connection portion 310*d* includes threads 318*d* that are finer (e.g., include a smaller pitch) than the threads 194*d* of the second connection portion 314*d*. In alternative embodiments, the arm 46*d* may be threaded along the length base 182*d*, or along a partial length of the base 182*d*. In alternative embodiments, the arm 46*d* may be secured to the receptacle 150 via fasteners.

The base 182*d* includes one or more elongated slots 166*d*, 322*d*, or apertures, extending through the base 182*d*. In other constructions, the elongated slot(s) 166*d* are recessed within the base 182*d* and do not extend completely through the base 182*d*. In the illustrated embodiments, the base 182*d* includes one elongate slot 322*d* extending along the first connection portion 310*d*, and two elongate slots 166*d* extending between the first connection portion 310*d* and the second connection portion 314*d*. The first connection portion 310*d* additionally includes a cylindrical aperture 323*d* extending through the base 182*d*. Ends of the aperture 323*d* are shaped and sized to receive screws 326*d*. As will be explained in greater detail below, the screw 326*d* serves as an indicator. More specifically, the screw 326*d* indicates to the user a position in which the extension 186*d* needs to be secured to the base 182*d* in order to align with a plumbing fixture. In alternative embodiments, the apertures may receive different fasteners. In other alternative embodiments, the slots 166*d*, 322*d* and/or aperture 323*d* may include additional shapes or sizes, and/or extend along a shorter or longer portion of the base 182*d*. Additionally, in alternative embodiments, the base 182*d* may include fewer or more slots and/or apertures.

The extension 186*d* includes a first end 185*d*, and a second end 187*d* opposite the first end 185*d*. The extension 186*d* is cylindrical and includes a bore, or opening, 325*d* extending from the second end 187*d* of the extension 186*d* through a portion of the extension 186*d*. The extension 186*d* includes a solid portion 282*d*, and a hollow portion 286*d*. The solid portion 282*d* includes an elongate slot 290*d*, or aperture, extending through the extension 186*d*. In the illustrated embodiments, the solid portion 282*d* includes one slot 290*d*. However, in alternative embodiments, the solid portion 282*d* may include fewer or more slots.

An internal surface of the hollow portion 286*d* includes threads corresponding to the threads on the first connection portion 310*d* of the base 182*d*. As previously mentioned, the threads 318*d* on the first connection portion 310*d* are finer than the threads 194*d* on the second connection portion 314*d*. The finer threads allow for finer adjustment of the extension 186*d* relative to the base 182*d*. The hollow portion 286*d* includes a first elongate slot 294*d* and a second elongate slot 296*d* extending through the extension 186*d*. The first elongate slot 294*d* extends along an axis parallel to and collinear with an axis of the elongate slot 290*d* of the solid portion 282*d*, and the second elongate slot 296*d* extends along an axis parallel to and offset from the axis of the elongate slot 290*d* of the solid cylindrical portion 282*d*.

In order to position the arm 46*d* during operation, the user secures the arm 46*d* to the fixture by threading the second connection portion 314*d* of the base 182*d* into the receptacle 150. The user then positions (e.g., threads) a lock nut (or like fastener) onto the first connection portion 310*d*, and then positions the extension 186*d* relative to the base 182*d*. Specifically, the user threads the second end 187*d* of the extension 186*d* onto the first connection portion 310*d* of the base 182*d*. As the extension 186*d* is threaded onto the base 182*d*, the lock nut rotates with the extension 186*d*, increasing the stability of the arm 46*d*. The extension 186*d* may be threadably coupled to the base 182*d* in a retracted position (FIG. 14A), in which the base 182*d* is retracted into the extension 186*d*, a fully extended position, in which the extension 186*d* extends away from the base 182*d*, or a plurality of partially extended positions (FIG. 14B) between the retracted position and the fully extended position. More specifically, in the retracted position, the first end of the base 182*d* abuts an end of the solid cylindrical portion 282*d*, and in the fully extended position, the first end of the base 182*d* is positioned adjacent the second end 187*d* of the extension 186*d*.

When the extension 186*d* is in the retracted position, or one of the partially extended positions, the cylindrical aperture of the first connection portion 310*d* aligns with the second elongate slot 296*d* of the hollow cylindrical portion 286*d*. The user inserts the screws 326*d* through the second slot 296*d* and into the cylindrical aperture of the first connection portion 310*d*, thereby securing the extension 186*d* to the base 182*d*. The screws 326*d* indicate where the extension 186*d* needs to be positioned relative to the arm 46*d* in order to align with the plumbing fixture. When the screws 326*d* are fully inserted into the second slot 296*d* and the aperture, the extension 186*d* is prevented from rotating relative to the base 182*d*.

In order to secure the arm 46*d* to the plumbing fixture, the user inserts fasteners (e.g., pins) through the elongate slots 166*d*, 322*d* of the base 182*d*, the first elongate slot 294*d* of the hollow cylindrical portion 286, and the slot 290*d* of the solid cylindrical portion 282*d*. The fasteners then protrude through corresponding apertures on the plumbing fixture during use, securing the arm 46*d* to the plumbing fixture.

FIGS. 15A-19B illustrate another embodiment of an arm 46*e*, with like components designated with an "e." The arm 46*e* is largely identical to the arms 46, 50, with some differences, as described below.

Figure 15A:
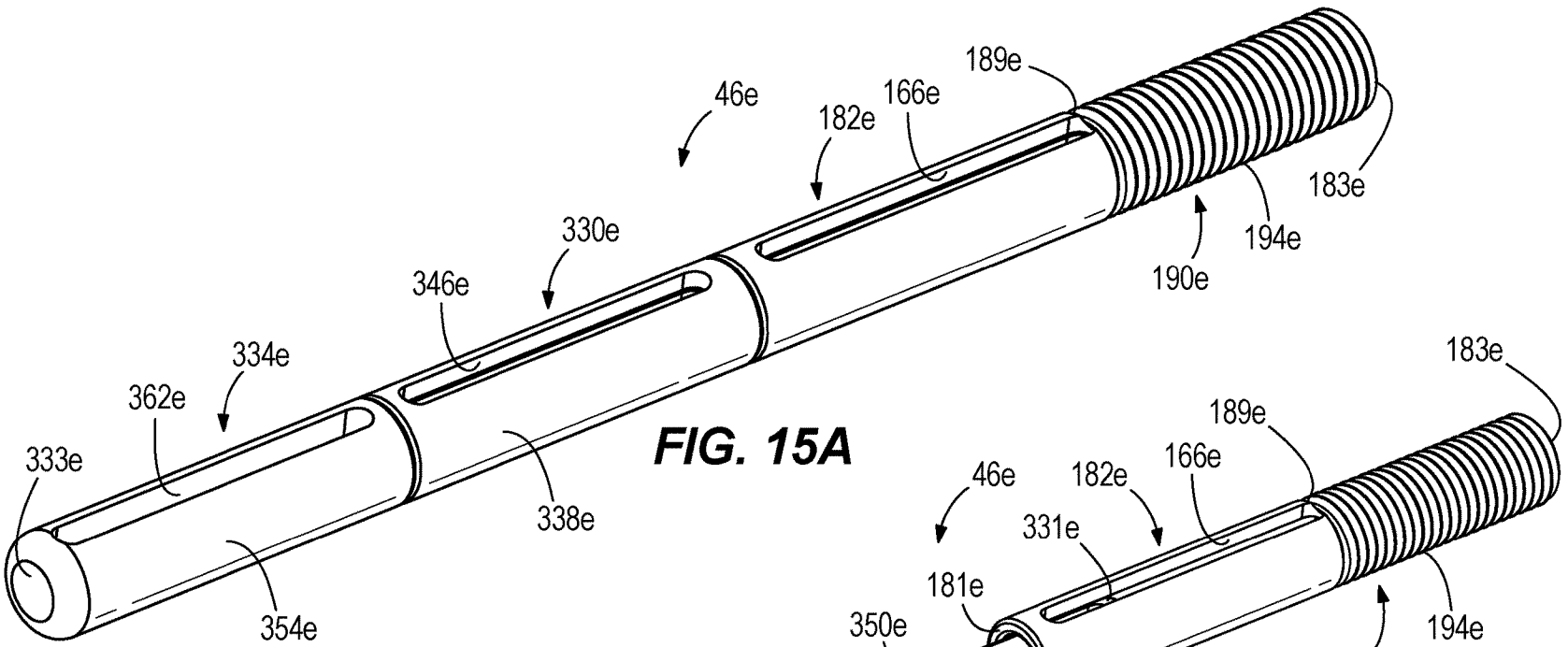
FIG. 15A is a perspective view of an alternative arm for use with the fixture carrier of FIG. 1 in a retracted position.
Figure 15B:
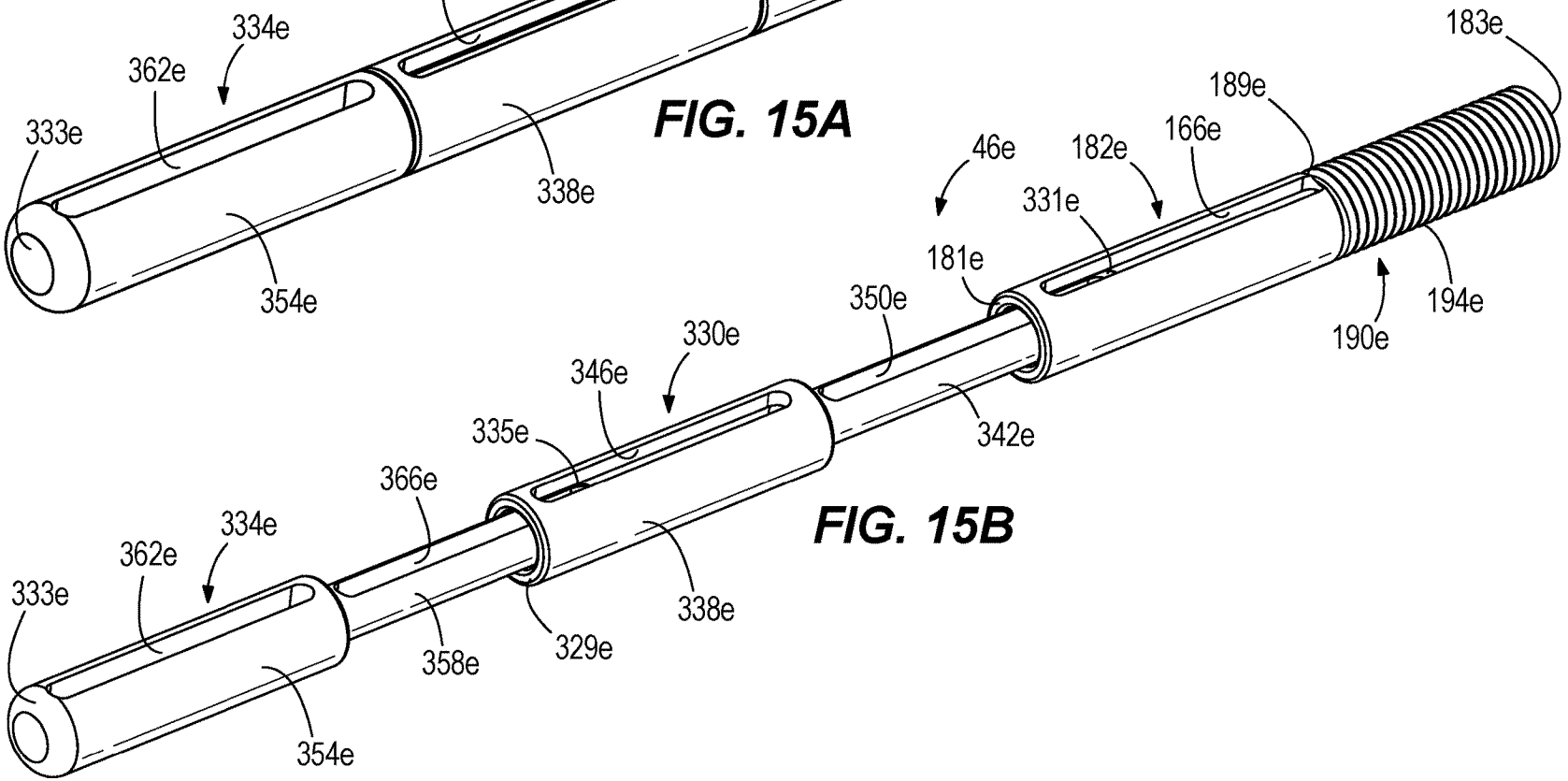
FIG. 15B is a perspective view of the arm of FIG. 15A in an extended position.
Figure 16A:
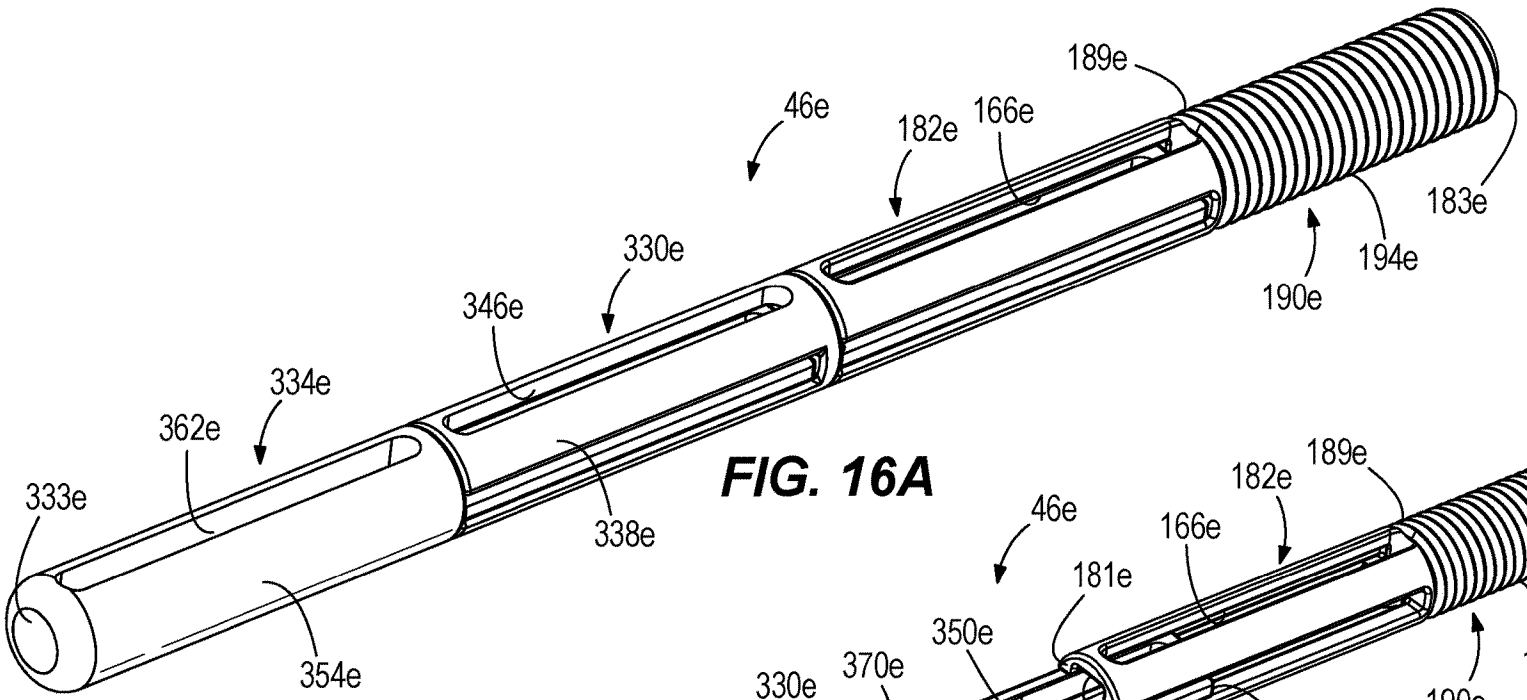
FIG. 16A is a perspective view of an alternative arm for use with the fixture carrier of FIG. 1 in a retracted position.
Figure 16B:
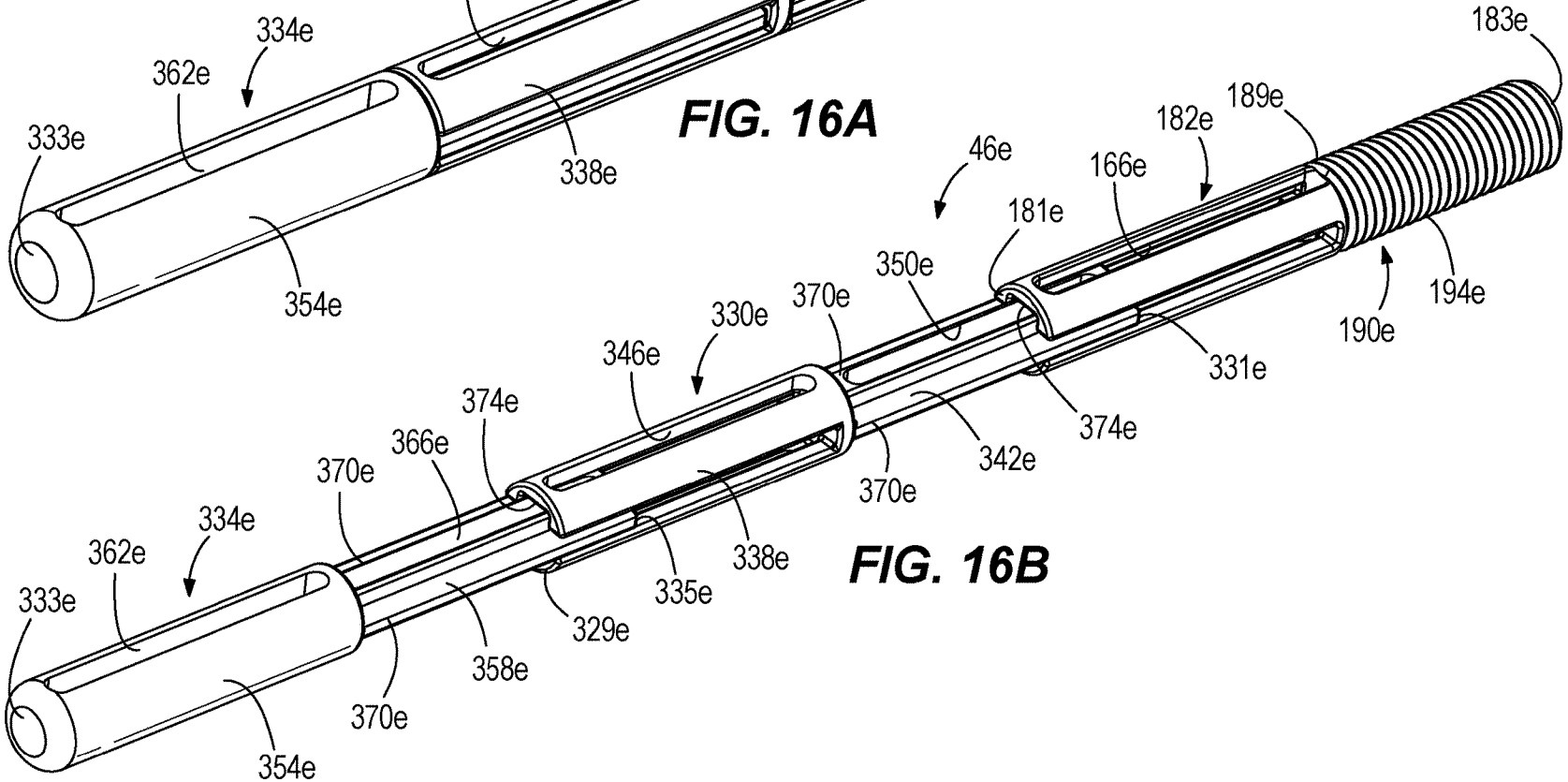
FIG. 16B is a perspective view of the arm of FIG. 16A in an extended position.
Figure 17A:
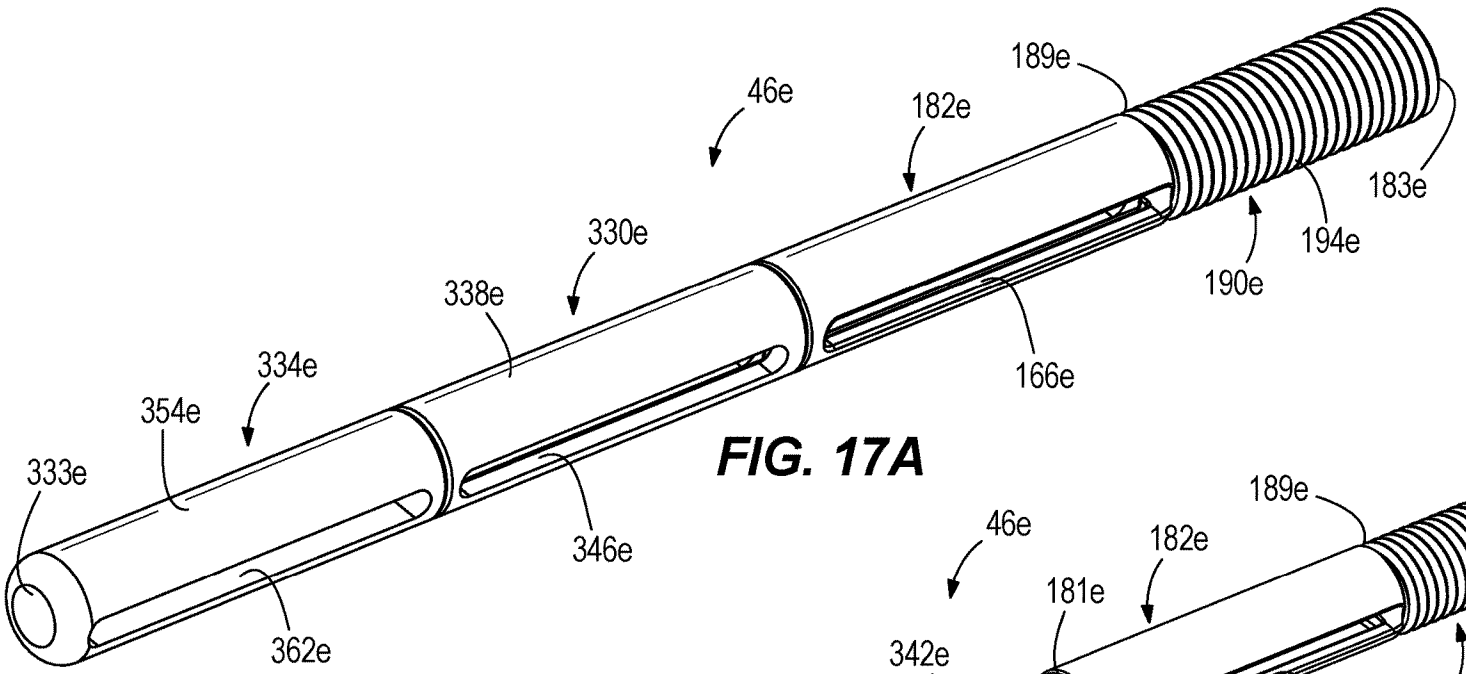
FIG. 17A is a perspective view of an alternative arm for use with the fixture carrier of FIG. 1 in a retracted position.
Figure 17B:
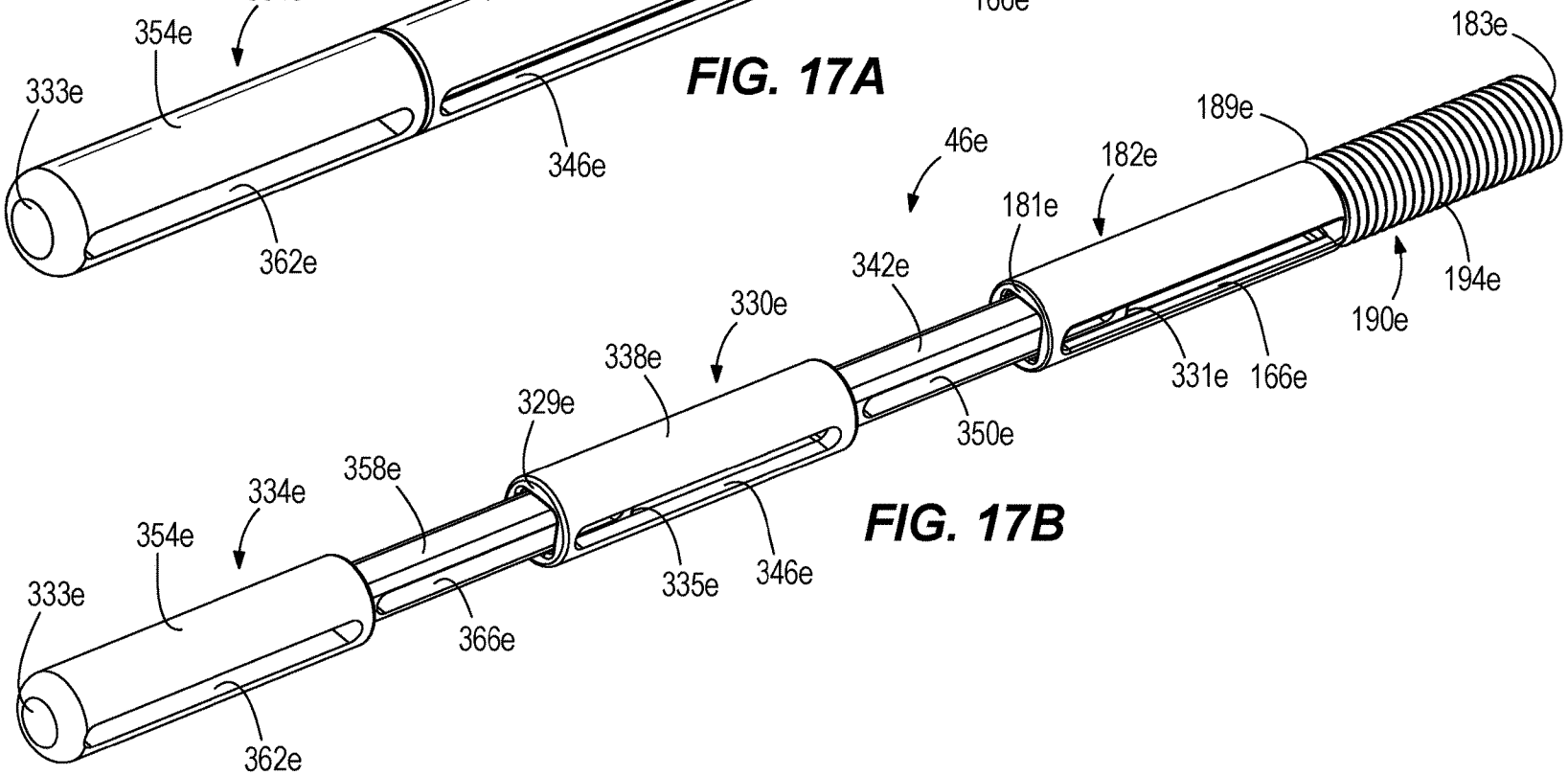
FIG. 17B is a perspective view of the arm of FIG. 17A in an extended position.
Figure 18A:
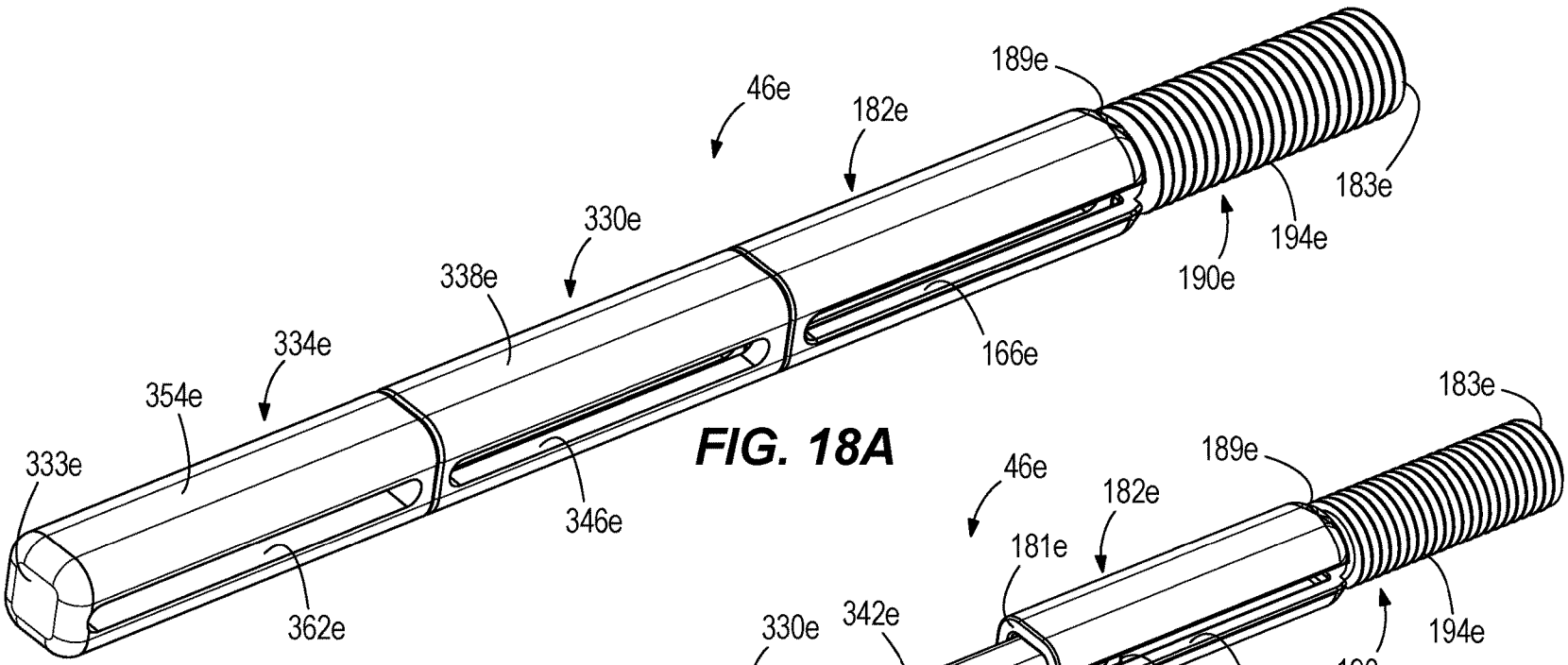
FIG. 18A is a perspective view of an alternative arm for use with the fixture carrier of FIG. 1 in a retracted position.
Figure 18B:
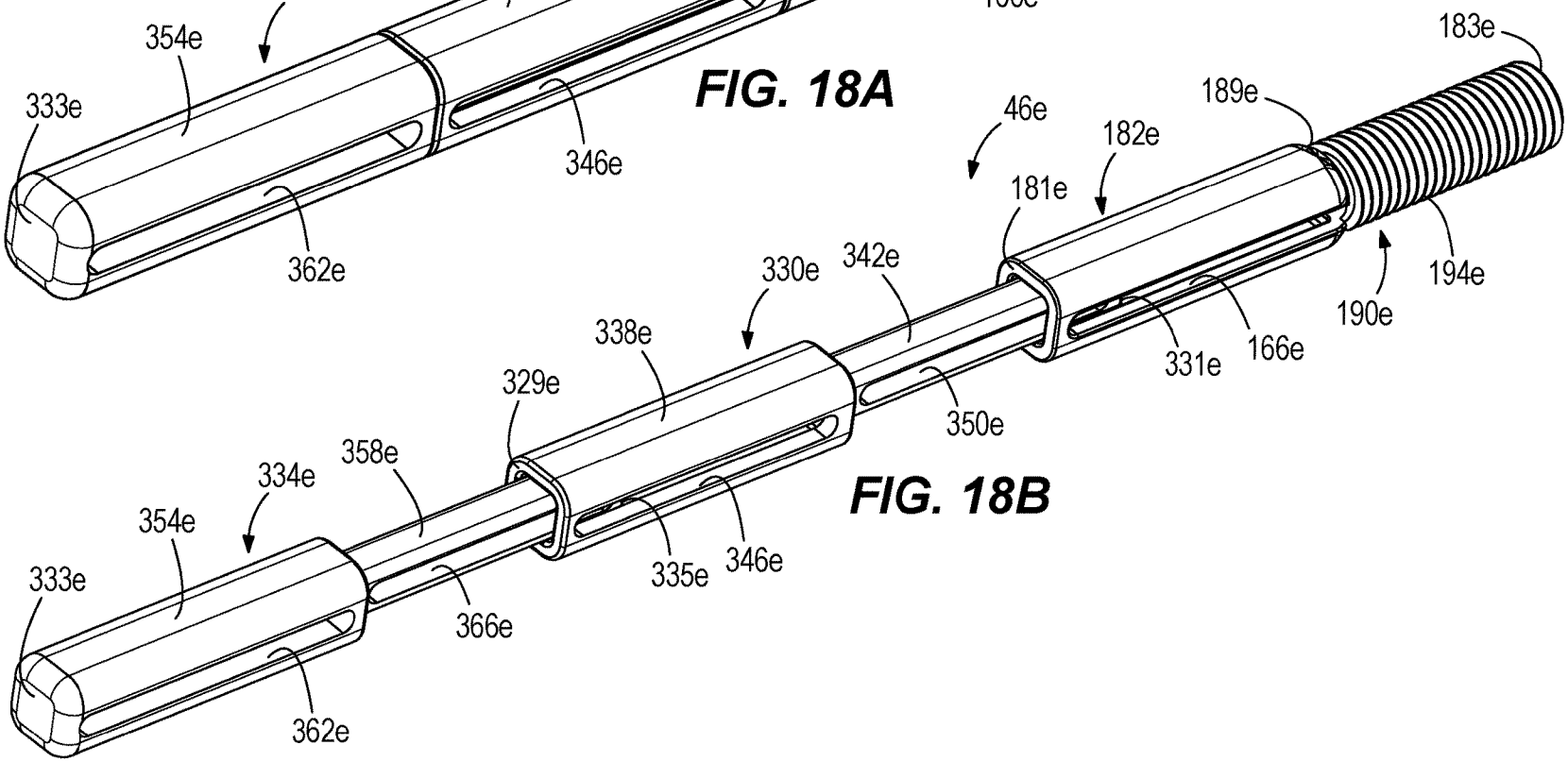
FIG. 18B is a perspective view of the arm of FIG. 18A in an extended position.
Figure 19A:
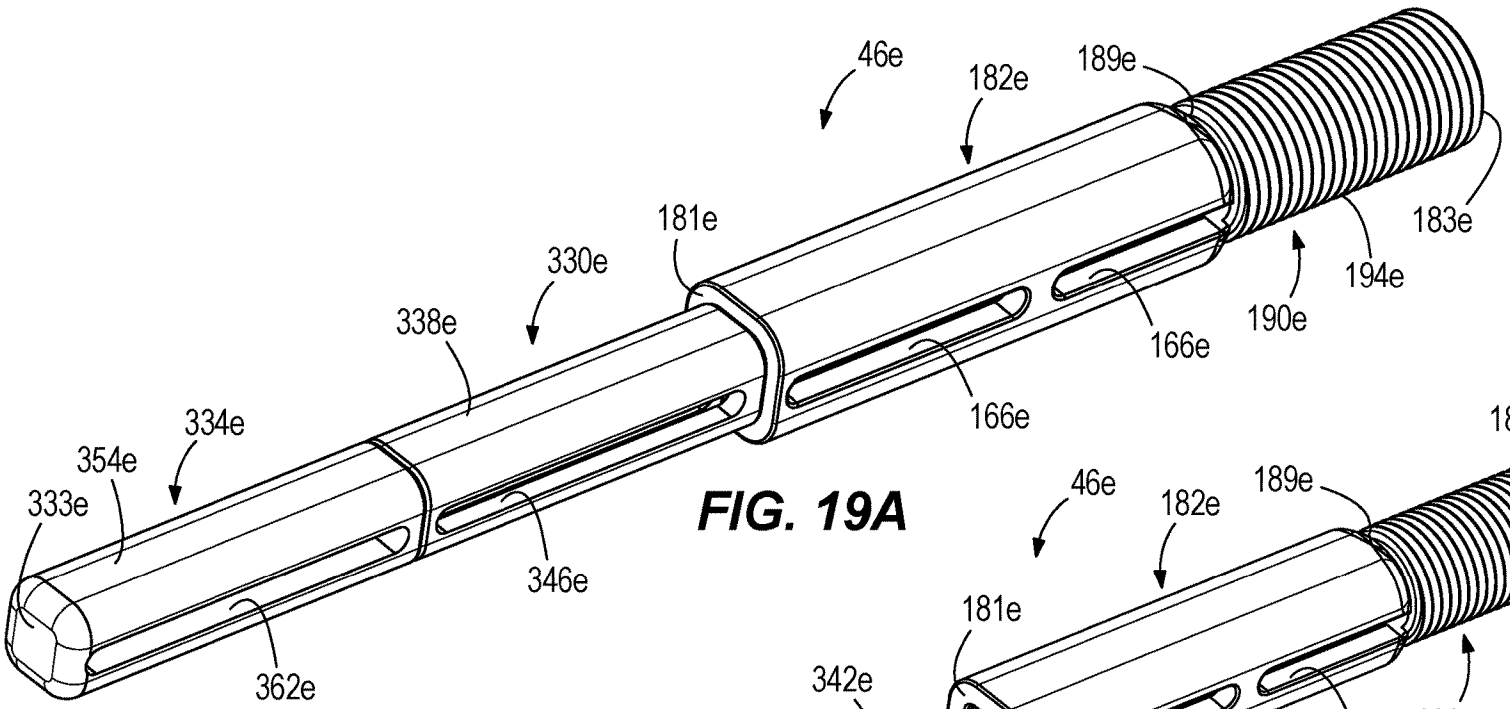
FIG. 19A is a perspective view of an alternative arm for use with the fixture carrier of FIG. 1 in a retracted position.
Figure 19B:
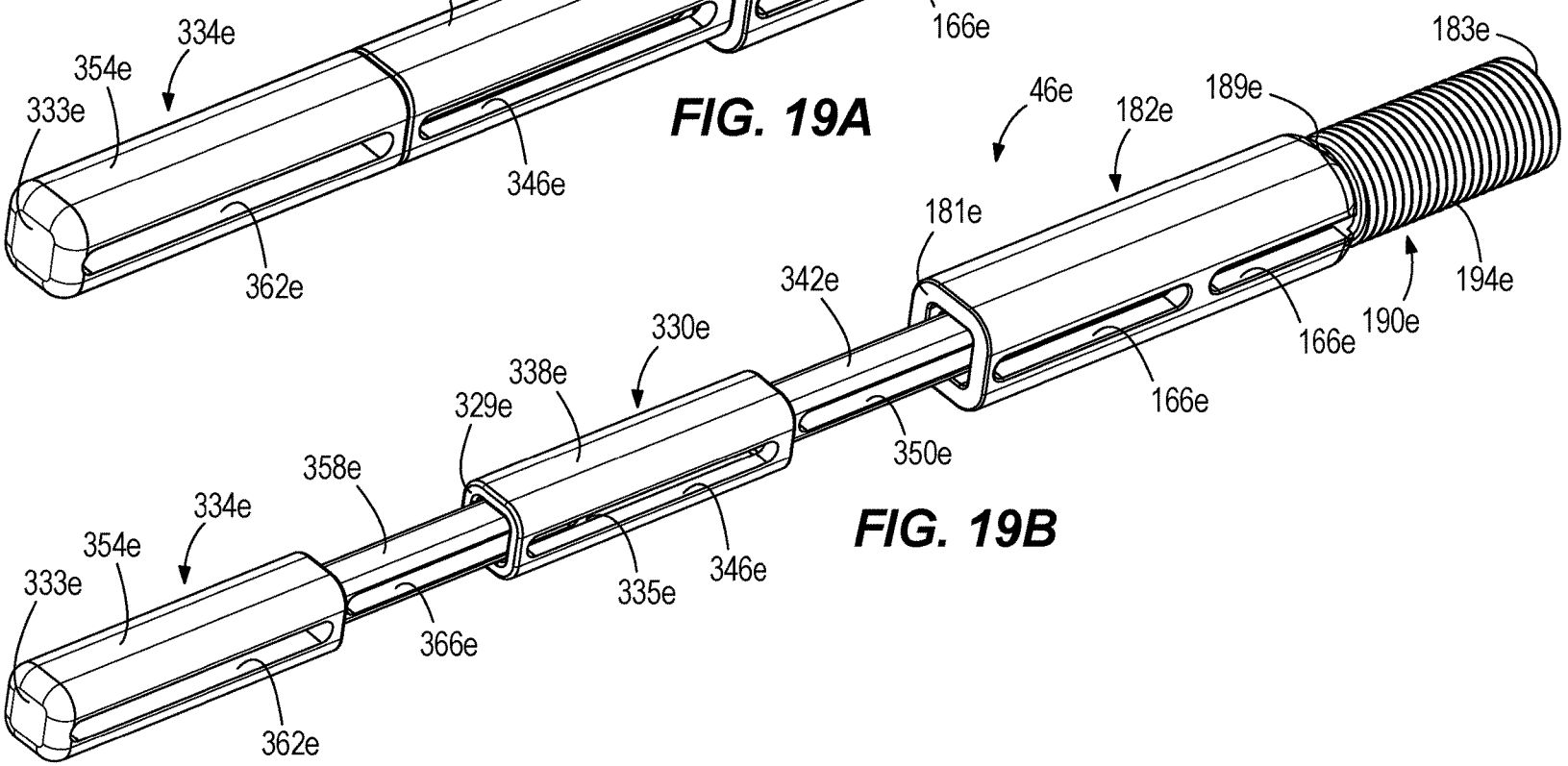
FIG. 19B is a perspective view of the arm of FIG. 19A in an extended position.

With reference to FIGS. 15A-15B, the arm 46*e* is cylindrical in cross-section. The arm 46*e* includes a stationary base 182*e*, a first extension 330*e*, which is movable relative to the base 182*e*, and a second extension 334*e*, which is movable relative to the first extension 330*e*. The base 182*e* includes a first end 181*e*, and a second end 183*e* opposite the first end 181*e*. The first end 181*e* extends outward from the frame 14 and the second end 183*e* of the base 182*e* is secured to the receptacle 150 of the plate 66, 70. The second end 183*e* of the base 182*e* includes a connection portion 190*e* having threads 194*e* corresponding to the threads positioned on the inner surface of the receptacle 150. Therefore, the connection portion 190*e* of the arm 46*e* is threadably coupled to the receptacle 150. In alternative embodiments, the arm 46*e* may be threaded along the length of partial length of the base 182*e*. In alternative embodiments, the arm 46*e* may be secured to the receptacle 150 via fasteners.

A portion of the base 182*e* extending from the first end 181*e* of the base 182 to a first end 189*e* of the connection portion 190*e* is hollow and includes a channel (not shown). An elongate slot 166*e*, or aperture, extends through the base 182*e* and extends between the first end 181*e* of the base 182*e* and the first end 189*e* of the connection portion 190*e*. In alternative embodiments, the slot 166*e* may include additional shapes or sizes, and/or extend along a shorter or longer portion of the base. In some constructions, the elongate slot 166*e* is recessed within the base 182*e* and does not extend completely through the base 182*e*. Additionally, in alternative embodiments, the base 182*e* may include additional slots.

The first extension 330*e* includes a first end 329*e*, and a second end 331*e* opposite the first end 329*e*. The first extension 330*e* is cylindrical in cross-section and includes a main portion 338*e* and a reduced diameter portion 342*e*. The main portion 338*e* is hollow and includes an elongate slot 346*e*, or aperture, extending through the first extension 330*e*. The elongate slot 346*e* extends along the length of the main portion 338*e*, from the first end 329*e* of the first extension 330*e* to the reduced diameter portion 342*e*. The reduced diameter portion 342*e* is solid and includes a diameter smaller than a diameter of the main portion 338*e*. Specifically, the reduced diameter portion 342*e* is sized to be received within the channel of the base 182*e*. The reduced diameter portion 342*e* includes an elongate slot 350*e*, or aperture, extending through the first extension 330*e*. The elongate slot 350*e* extends along the length of the reduced diameter portion 350*e*, from the second end 331*e* of the first extension 330*e* to the main portion 338*e*. In alternative embodiments, the slots 346*e*, 350*e* of the first extension 330*e* may include additional shapes or sizes, and/or extend along a shorter or longer portion of the first extension 330*e*. Additionally, in alternative embodiments, the first extension 330*e* may include fewer or more slots.

The second extension 334*e* includes a first end 333*e*, and a second end 335*e* opposite the first end 333*e*. The second extension 334*e* is cylindrical in cross-section and includes a main portion 354*e* and a reduced diameter portion 358*e*. The main portion 358*e* is solid and includes an elongate slot 362*e*, or aperture, extending through the second extension 334*e*. The elongate slot 362*e* extends along the length of the main portion 354*e*, from the first end 333*e* of the second extension 334*e* to the reduced diameter portion 358*e*. The reduced diameter portion 358*e* is solid and includes a diameter smaller than a diameter of the main portion 354*e*. Specifically, the reduced diameter portion 358*e* is sized to be received within the hollow, main portion 338*e* of the first extension 330*e*. The reduced diameter portion 358*e* includes an elongate slot 366*e*, or aperture, extending through the second extension 334*e*. The elongate slot 366*e* extends along the length of the reduced diameter portion 358*e*, from the second end 335*e* of the second extension 334*e* to the main portion 354*e*. In alternative embodiments, the slots 362*e*, 366*e* of the second extension 334*e* may include additional shapes or sizes, and/or extend along a shorter or longer portion of the second extension 334*e*. Additionally, in alternative embodiments, the second extension 334*e* may include fewer or more slots. In the illustrated embodiments, the second extension 334*e* is identical in size to the first extension 330*e*. Additionally, the hollow, cylindrical portion of the base, the main portion 338*e* of the first extension 330*e*, the reduced diameter portion 342*e* of the first extension

330*e*, the main portion 354*e* of the second extension 334*e*, and the reduced diameter portion 358*e* of the second extension 334*e* have the same length. However, in alternative embodiments, the components may include different lengths.

The arm 46*e* may additionally or alternatively include a sleeve, or collar, (not shown) supported by the arm 46*e* movable (e.g., slidable) along the arm 46*e*. The sleeve includes an outer surface engageable by the user to move the sleeve relative to the arm 46*e*. Specifically, the sleeve may be two washers secured together via a fastener (e.g., a bolt, etc.). The sleeve clamps around the arm 46*e* in order to secure the first extension 330*e* and the second extension 334*e* to the base 182*e* in a given position. In some embodiments, the sleeve includes apertures extending through the sleeve. The apertures, the slots 166*e* on the base 182*e*, and the slots 346*e*, 350*e*, 362*e*, 366*e* on the extensions 330*e*, 334*e* are shaped and sized to fasteners (e.g., pins). In the illustrated embodiments, the arm 46*e* includes a first sleeve to secure the first extension 330*e* to the base 182*e* in a given position, and a second sleeve to secure the second extension 334*e* to the first extension 330*e* in a given position.

In order to position the arm 46*e* during operation, the user secures the arm 46*e* to the fixture by threading the connection portion 190*e* of the base 182*e* into the receptacle 150. The user then positions the extensions 330*e*, 334*e* relative to the base 182*e*. Specifically, the user slides the first extension 330*e* relative to the base 182*e* and the second extension 334*e* relative to the first extension 330*e*, causing the reduced diameter portion 342*e* of the first extension 330*e* to telescope in and out of the hollow cylindrical portion of the base 182*e*, and the reduced diameter portion 358*e* of the second extension 334*e* to telescope in and out of the main portion 338*e* of the first extension 330*e*. The extensions 330*e*, 334*e* may be coupled to the base 182*e* in a retracted position (FIG. 15A), a partially extended position, or a fully extended position (FIG. 15B). In the retracted position, the reduced diameter portion 342*e* of the first extension 330*e* is seated within the hollow cylindrical portion of the base 182*e* and the reduced diameter portion 358*e* of the second extension 334*e* is seated within the main portion 338*e* of the first extension 330*e*. In the partially extended position, the reduced diameter portion 342*e* of the first extension 330*e* is seated within the hollow cylindrical portion of the base 182*e* and the reduced diameter portion 358*e* of the second extension 334*e* is extended out of the main portion 338*e* of the first extension 330*e*. In the fully extended position, the reduced diameter portion 342*e* of the first extension 330*e* is extended out of the hollow cylindrical portion of the base 182*e* and the reduced diameter portion 358*e* of the second extension 334*e* is extended out of the main portion 338*e* of the first extension 330*e*. The extensions 330*e*, 334*e* may additionally be coupled to the base 182*e* in a plurality of positions between the retracted position and the partially extended position, and a plurality of positions between the partially extended position and the fully extended position.

In order to couple the extensions 330*e*, 334*e* to the base 182*e* in a given position, the user secures the first clamp around the first extension 330*e* and the base 182*e*, and the second clamp around the first extension 330*e* and the second extension 334*e*. The user then positions fasteners (e.g., pins) through the slots 166*e*, 346*e*, 350*e*, 362*e*, 366*e*. The fasteners may then protrude through corresponding apertures on the plumbing fixture during use, securing the arm 46*e* to the plumbing fixture.

In some embodiments (FIGS. 16A-16B), the reduced diameter portions 342*e*, 358*e* of the first and second extension 330*e*, 334*e* are keyed. More specifically, the reduced diameter portions 342*e*, 358*e* include four rails 370*e* extending parallel to each other, and extending from the second end 331*e*, 335*e* of the extensions 330*e*, 334*e* to the main portions 338*e*, 354*e* of the extensions 330*e*, 334*e*. In such instances, an inner surface (not shown) of the hollow cylindrical portion of the base 182*e* and an inner surface (not shown) of the main body 338*e* of the first extension 330*e* are keyed. Specifically, the inner surfaces include grooves 374*e* forming a shape corresponding to the shape of the reduced diameter portions 342*e*, 358*e*.

During positioning of the arm 46*e*, the user telescopes the reduced diameter portion 342*e* of the first extension 330*e* into and out of the hollow cylindrical portion of the base 182*e*, and the reduced diameter portion 358*e* of the second extension 334*e* into and out of the main portion 338*e* of the first extension 330*e*, causing the rails 370*e* of the extensions 330*e*, 334*e* to slide along the corresponding grooves 374*e*. The rails 370*e* and grooves 374*e* prevent rotation of the first and second extensions 330*e*, 334*e* relative to the base 182*e*.

In some embodiments (FIGS. 17A-17B), the reduced diameter portions 342*e*, 358*e* of the first and second extension 330*e*, 334*e* include a rectangular cross-section. In such instances, the inner surface of the hollow cylindrical portion of the base 182*e* and the inner surface of the main portion 338*e* of the first extension 330*e* have a corresponding, rectangular shape.

In some embodiments (FIGS. 18A-18B), the entire arm 46*e* includes a rectangular cross-section. In such instances, an outer surface of the hollow cylindrical portion of the base 182*e*, the main portion 338*e* and the reduced diameter portion 342*e* of the first extension 330*e*, and the main portion 354*e* and the reduced diameter portion 358*e* of the second extension 334*e* are rectangular. Additionally, the inner surfaces of the hollow cylindrical portion of the base 182*e* and the main portion 338*e* of the first extension 330*e* are rectangular. The rectangular shape prevents rotation of the first and second extensions 330*e*, 334*e* relative to the base 182*e* during operation.

In some embodiments (FIGS. 19A-19B), the outer surface of the hollow cylindrical portion of the base 182*e* includes a larger, thicker diameter than the outer surface of the first and second extensions 330*e*, 334*e*. In such instances, the thicker diameter of the hollow cylindrical portion increases the durability of the base 182*e*. Therefore, when the arm 46*e* is positioned against the plumbing fixture, the arm 46*e* is capable of withstanding greater stress.

FIGS. 20A-21B illustrate another embodiment of an arm 46*f*, with like components designated with an "f" The arm 46*f* is largely identical to the arms 46, 50, with some differences, as described below.

Figure 20A:
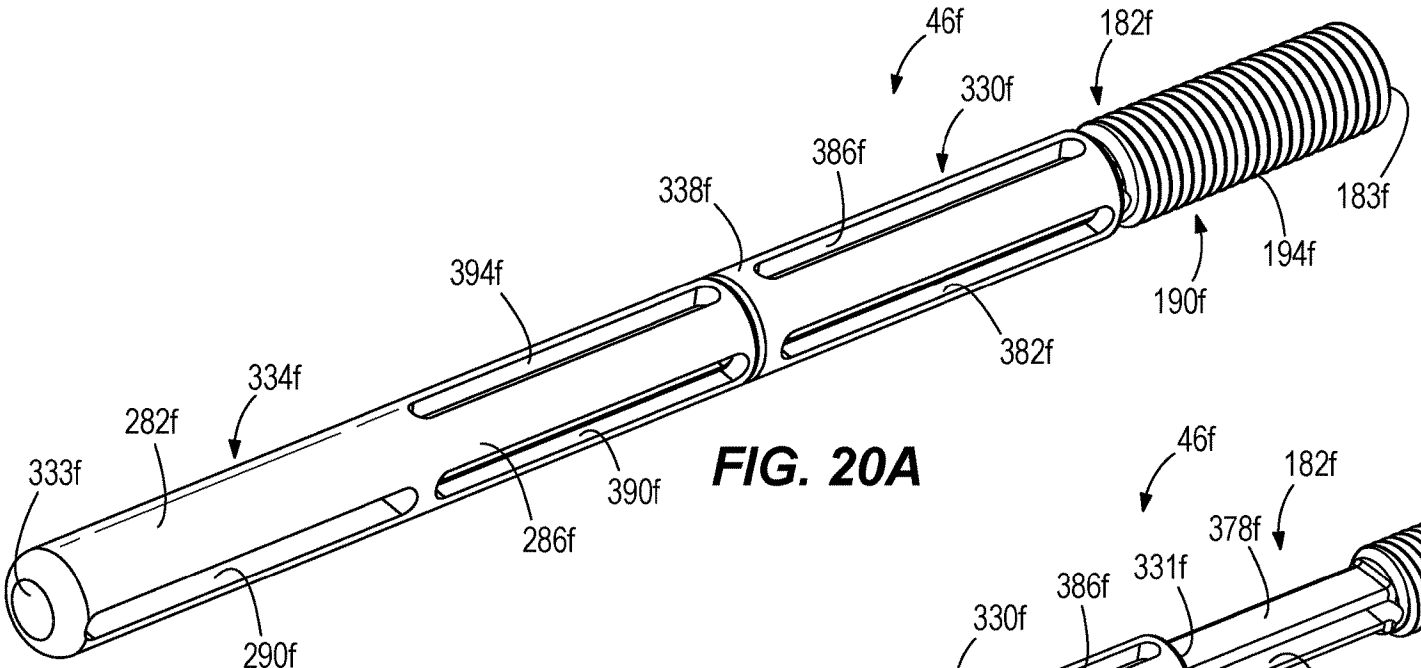
FIG. 20A is a perspective view of an alternative arm for use with the fixture carrier of FIG. 1 in a retracted position.
Figure 20B:
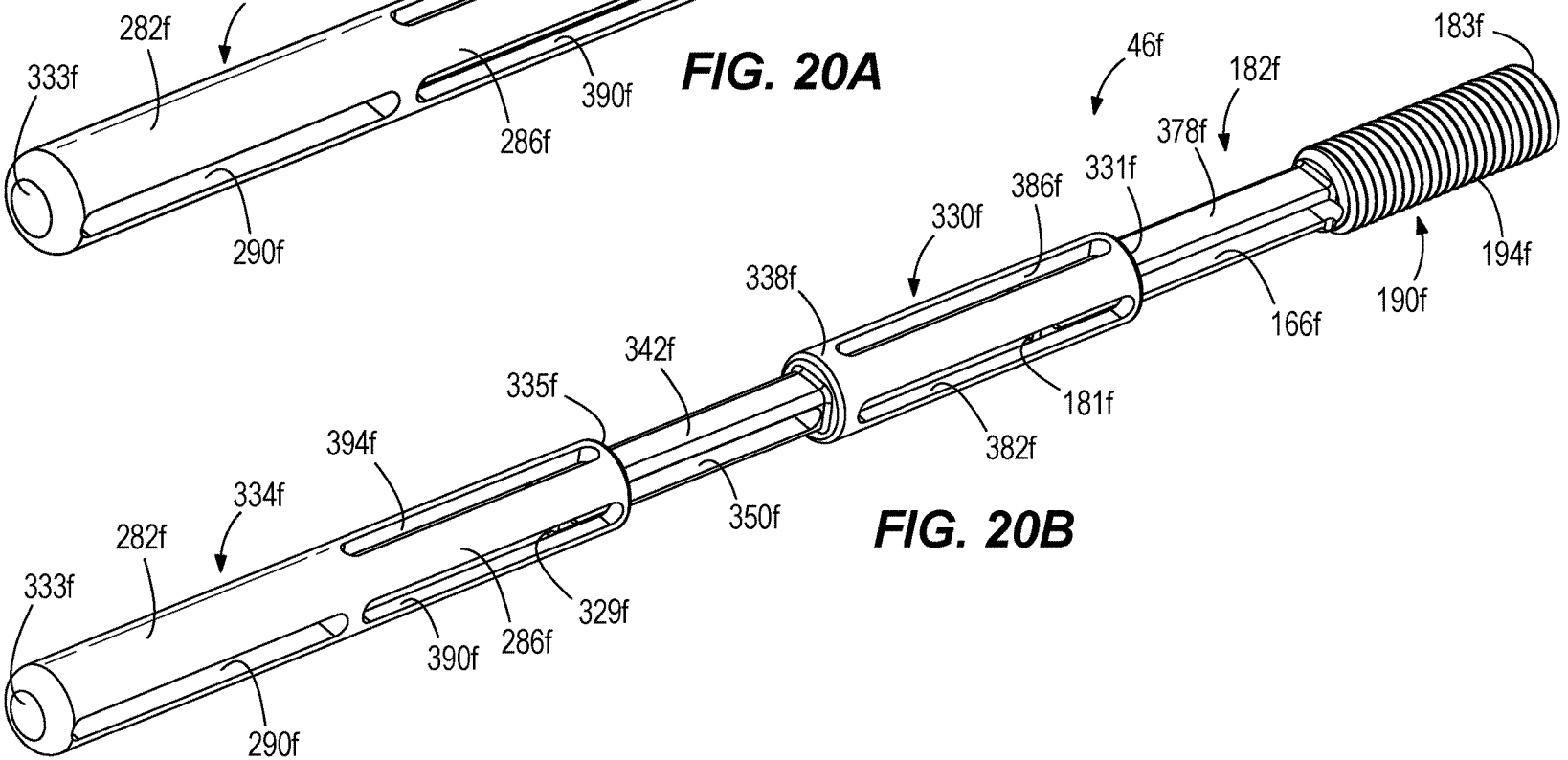
FIG. 20B is a perspective view of the arm of FIG. 20A in an extended position.
Figure 21A:
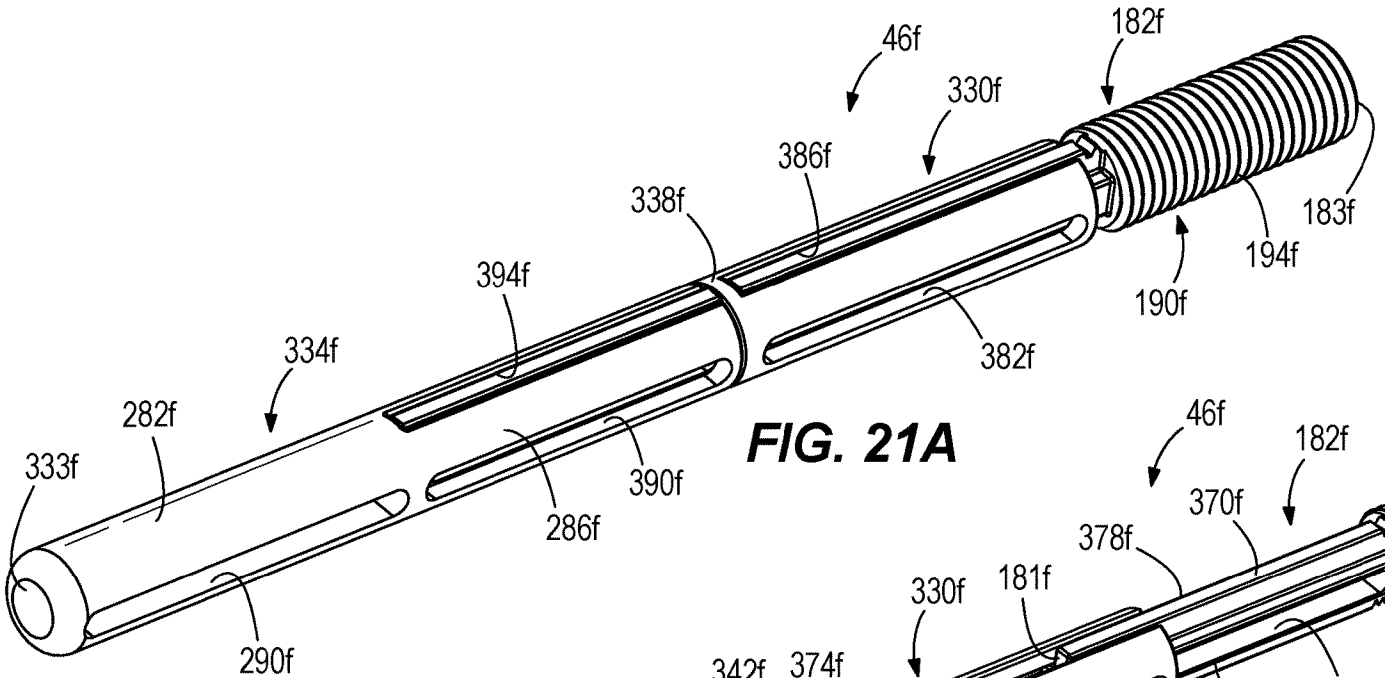
FIG. 21A is a perspective view of an alternative arm for use with the fixture carrier of FIG. 1 in a retracted position.
Figure 21B:
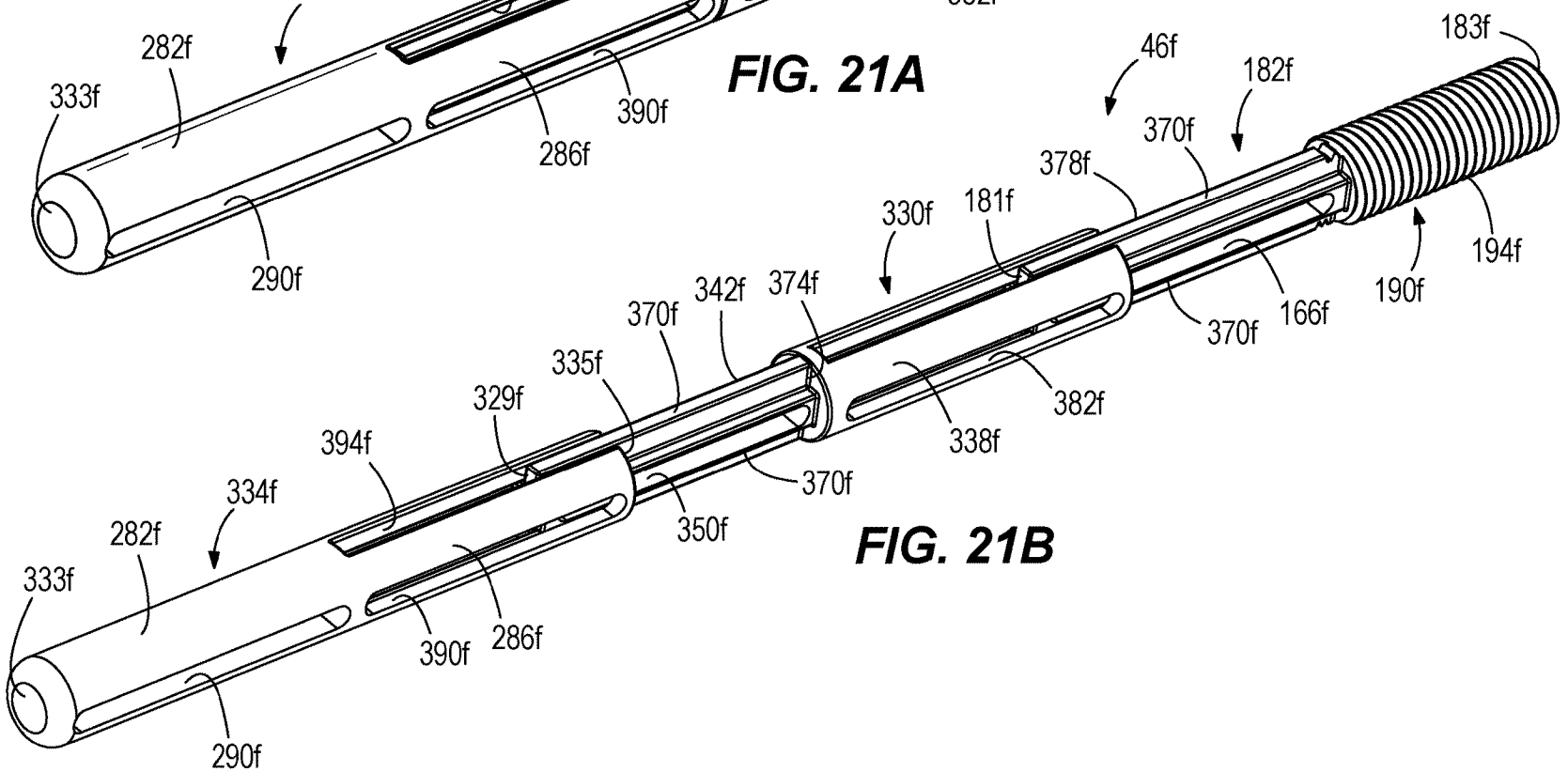
FIG. 21B is a perspective view of the arm of FIG. 21A in an extended position.

With reference to FIGS. 20A-20B, the arm 46*f* is cylindrical in cross-section. The arm 46*f* includes a stationary base 182*f*, a first extension 330*f*, which is movable relative to the base 182*f*, and a second extension 334*f*, which is movable relative to the first extension 330*f* The base 182*f* includes a first end 181*f*, and a second end 183*f* opposite the first end 181*f*. The first end 181*f* extends outward from the frame 14 and the second end 183*f* of the base 182*f* is secured to the receptacle 150 of the plate 66, 70. The second end 183*f* of the base 182*f* includes a connection portion 190*f* having threads 194*f* corresponding to the threads positioned on the inner surface of the receptacle 150. Therefore, the connection portion 190*f* of the arm 46*f* is threadably coupled to the receptacle 150. In alternative embodiments, the arm 46*f* may be threaded along the length of partial length of the base

182*f*. In alternative embodiments, the arm 46*f* may be secured to the receptacle 150 via fasteners.

The base 182*f* includes a reduced diameter portion 378*f* extending from the first end 181*f* of the base 182*f* to the connection portion 190*f* The reduced diameter portion 378*f* is solid and includes a rectangular cross-section. However, in some embodiments, the reduced diameter portion 378*f* may include a cross-section of alternative shapes. The reduced diameter portion 378*f* includes a diameter smaller than a diameter of the connection portion 190*f*. An elongate slot 166*f*, or aperture, extending through the base 182*f* between the first end 181*f* of the base 182*f* and the connection portion 190*f*. In alternative embodiments, the slot 166*f* may include additional shapes or sizes, and/or extend along a shorter or longer portion of the base 182*f* In some constructions, the elongate slot 166*f* is recessed within the base 182*f* and does not extend completely though the base 182*f* Additionally, in alternative embodiments, the base 182*f* may include additional slots.

The first extension 330*f* includes a first end 329*f*, and a second end 331*f* opposite the first end 329*f*. The first extension 330*f* includes a cylindrical main portion 338*f* and a rectangular reduced diameter portion 342*f*. The main portion 338*f* is hollow and includes an inner surface having a rectangular shape. Specifically, the inner surface forms a chamber shaped and sized to receive the reduced diameter portion 378*f* of the base 182*f*. The main portion 338*f* additionally includes a first elongate slot 382*f*, or aperture, extending through the first extension 330*f*, and a second elongate slot 386*f*, or aperture, extending partially through the main portion 338*f* and into the chamber. The elongate slots 382*f*, 386*f* extend along the length of the main portion 338*f*, from the second end 331*f* of the first extension 330*f* to the reduced diameter portion 342*f*. The reduced diameter portion 342*f* is solid and includes a diameter smaller than a diameter of the main portion 338*f*. The reduced diameter portion 342*f* includes an elongate slot 350*f*, or aperture, extending through the first extension 330*f*. The elongate slot 350*f* extends along the length of the reduced diameter portion 342*f*, from the first end 329*f* of the first extension 330*f* to the main portion 338*f* In alternative embodiments, the slots 350*f*, 382*f*, 386*f* of the first extension 330*f* may include additional shapes or sizes, and/or extend along a shorter or longer portion of the first extension 330*f*. Additionally, in alternative embodiments, the first extension 330*f* may include fewer or more slots.

The second extension 334*f* includes a first end 333*f*, and a second end 335*f* opposite the first end 333*f*. The second extension 334*f* is cylindrical and includes an opening extending from the second end 335*f* of the extension 334*f* through a portion of the extension 334*f*. The opening forms a solid cylindrical portion 282*f*, and a hollow cylindrical portion 286*f*. The solid cylindrical portion 282*f* includes an elongate slot 290*f*, or aperture, extending through the extension 334*f*. In the illustrated embodiments, the solid portion 282*f* includes one slot 290*f* However, in alternative embodiments, the solid portion 282*f* may include fewer or more slots. The hollow cylindrical portion 286*f* includes an inner surface having a rectangular shape. Specifically, the inner surface forms a chamber shaped and sized to receive the reduced diameter portion 342*f* of the first extension 330*f*. The hollow cylindrical portion 286*f* additionally includes a first elongate slot 390*f*, or aperture, extending through the second extension 334*f*, and a second elongate slot 394*f*, or aperture, extending partially through the hollow cylindrical portion 286*f* and into the chamber. The elongate slots 390*f*, 394*f* extend along the length of the hollow cylindrical portion 286*f*, from the second end 335*f* of the second extension 334*f* to the solid cylindrical portion 282*f*.

The arm 46*f* may additionally or alternatively include a sleeve, or collar, (not shown) supported by the arm 46*f* movable (e.g., slidable) along the arm 46*f*. The sleeve includes an outer surface engageable by the user to move the sleeve relative to the arm 46*f*. Specifically, the sleeve may be two washers secured together via a fastener (e.g., a bolt, etc.). The sleeve clamps around the arm 46*f* in order to secure the first extension 330*f* and the second extension 334*f* to the base 182*f* in a given position. In some embodiments, the sleeve includes apertures extending through the sleeve. The apertures, the slot 166*f* on the base 182*f*, and the slots 290*f*, 382*f*, 386*f*, 390*f*, 394*f* on the extensions 330*f*, 334*f* are shaped and sized to fasteners (e.g., pins). In the illustrated embodiments, the arm 46*f* includes a first sleeve to secure the first extension 330*f* to the base 182*f* in a given position, and a second sleeve to secure the second extension 334*f* to the first extension 330*f* in a given position.

In order to position the arm 46*f* during operation, the user secures the arm 46*f* to the fixture by threading the connection portion 190*f* of the base 182*f* into the receptacle 150. The user then positions the extensions 330*f*, 334*f* relative to the base. Specifically, the user slides the first extension 330*f* relative to the base 182*f* and the second extension 334*f* relative to the first extension 330*f*, causing the main portion 338*f* of the first extension 330*f* to telescope over the reduced diameter portion 378*f* of the base 182*f*, and the hollow cylindrical portion 286*f* of the second extension 334*f* to telescope over the reduced diameter portion 342*f* of the first extension 330*f*. The extensions 330*f*, 334*f* may be coupled to the base 182*f* in a retracted position (FIG. 20A), a partially extended position, or a fully extended position (FIG. 20B). In the retracted position, the reduced diameter portion 378*f* of the base 182*f* is seated within the main portion 338*f* of the first extension 330*f* and the reduced diameter portion 342*f* of the first extension 330*f* is seated within the hollow cylindrical portion 386*f* of the second extension 334*f*. In the partially extended position, the reduced diameter portion 378*f* of the base 182*f* is seated within the main portion 338*f* of the first extension 330*f* and the reduced diameter portion 342*f* of the first extension 330*f* is extended out of the hollow cylindrical portion 286*f* of the second extension 334*f*. In the fully extended position, the reduced diameter portion 378*f* of the base 182*f* is extended out of the main portion 338*f* of the first extension 330*f* and the reduced diameter portion 342*f* of the first extension 330*f* is extended out of the hollow cylindrical portion 286*f* of the second extension 334*f*. The extensions 330*f*, 334*f* may additionally be coupled to the base 182*f* in a plurality of positions between the retracted position and the partially extended position, and a plurality of positions between the partially extended position and the fully extended position.

In order to couple the extensions 330*f*, 334*f* to the base 182*f* in a given position, the user secures the first clamp around the first extension 330*f* and the base 182*f*, and the second clamp around the first extension 330*f* and the second extension 334*f* The user then positions fasteners (e.g., pins) through the slots. The fasteners may then protrude through corresponding apertures on the plumbing fixture during use, securing the arm 46*f* to the plumbing fixture.

In some embodiments (FIGS. 21A-21B), the reduced diameter portion 378*f* of the base 182*f* and the reduced diameter portion 342*f* of the first extension 330*f* are keyed. More specifically, the reduced diameter portions 342*f*, 378*f* include four rails 370*f* extending parallel to each other, and extending along the reduced diameter portions 342*f*, 378*f*. In such instances, the inner surface of the main portion 338*f* of the first extension 330*f* and the inner surface of the hollow cylindrical portion 286*f* of the second extension 334*f* are keyed. Specifically, the inner surfaces include grooves 374*f*, therefore the chamber includes a shape corresponding to the shape of the reduced diameter portions 342*f*, 378*f*.

During positioning of the arm 46*f*, the user telescopes the main portion 338*f* of the first extension 330*f* over the reduced diameter portion 378*f* of the base 182*f*, and the hollow cylindrical portion 286*f* of the second extension 334*f* over the reduced diameter portion 342*f* of the first extension 330*f*, causing the rails 370*f* of the reduced diameter portions 342*f*, 378*f* to slide along the corresponding grooves 374*f*. The rails 370*f* and grooves 374*f* prevent rotation of the first and second extensions 330*f*, 334*f* relative to the base 182*f*.

Figure 22A:
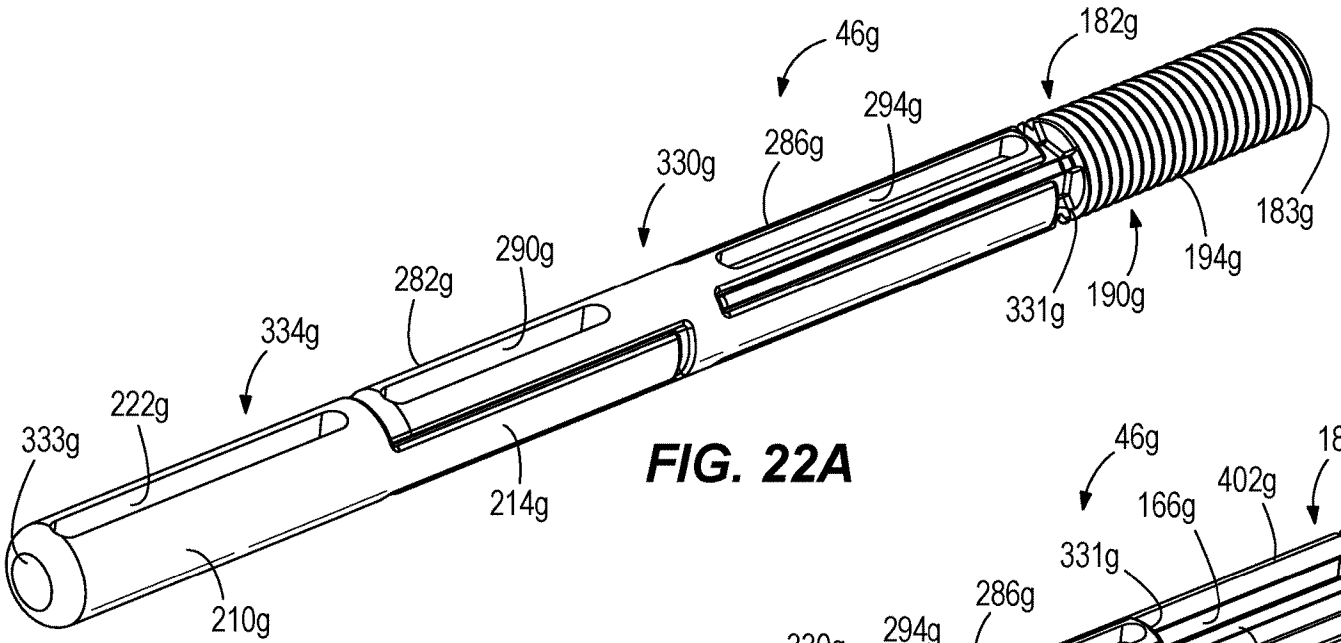
FIG. 22A is a perspective view of an alternative arm for use with the fixture carrier of FIG. 1 in a retracted position.
Figure 22B:
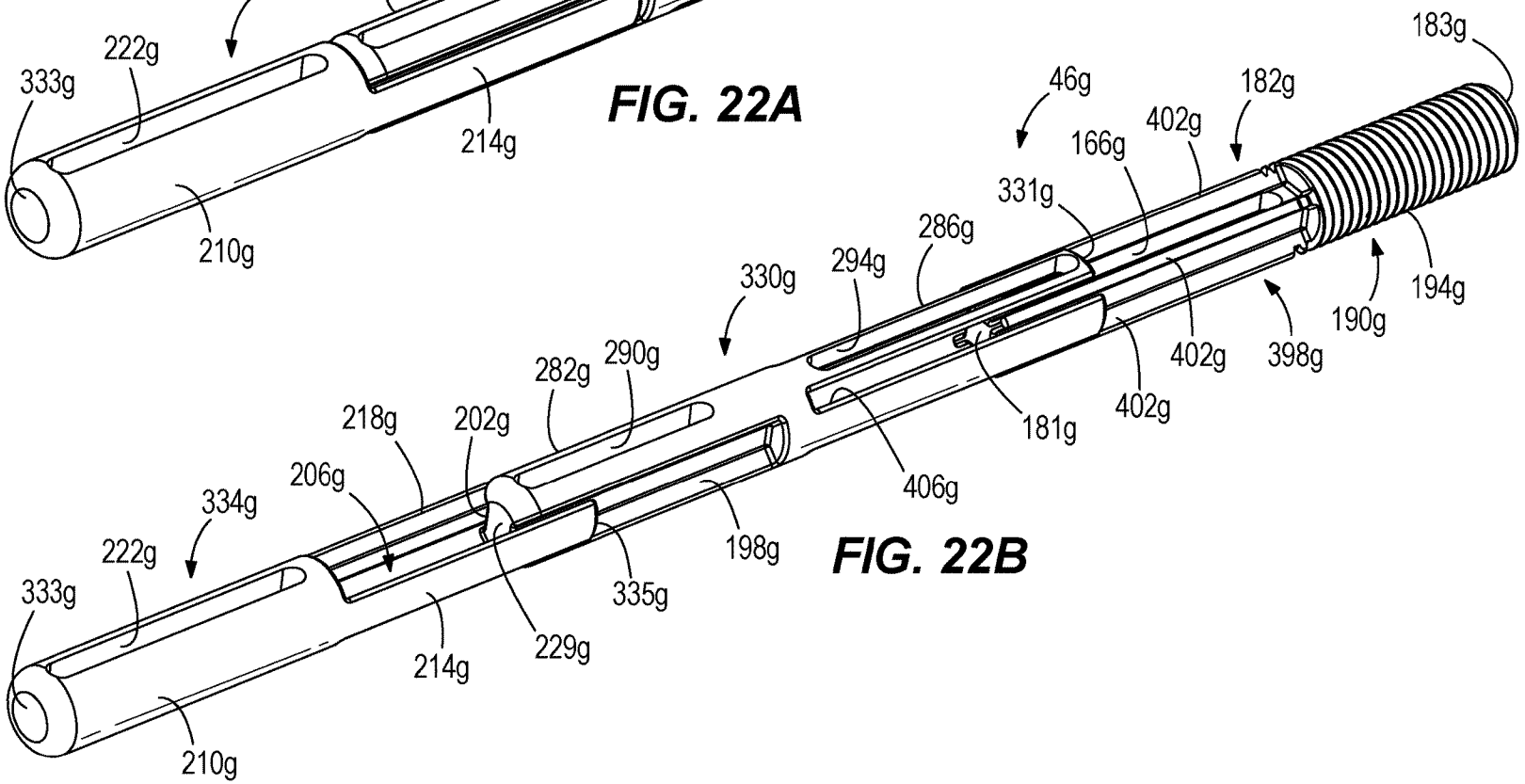
FIG. 22B is a perspective view of the arm of FIG. 22A in an extended position.

FIGS. 22A-22B illustrate another embodiment of an arm 46*g*, with like components designated with a "g." The arm 46*g* is largely identical to the arms 46, 50, with some differences, as described below.

With reference to FIGS. 22A-22B, the arm 46*g* is cylindrical in cross-section. The arm 46*g* includes a stationary base 182*g*, a first extension 330*g*, which is movable relative to the base 182*g*, and a second extension 334*g*, which is movable relative to the first extension 330*g*. The base 182*g* includes a first end 181*g*, and a second end 183*g* opposite the first end 181*g*. The first end 181*g* extends outward from the frame 14 and the second end 183*g* of the base 182*g* is secured to the receptacle 150 of the plate 66, 70. The second end 183*g* of the base 182*g* includes a connection portion 190*g* having threads 194*g* corresponding to the threads positioned on the inner surface of the receptacle 150. Therefore, the connection portion 190*g* of the arm 46*g* is threadably coupled to the receptacle 150. In alternative embodiments, the arm 46*g* may be threaded along the length of partial length of the base 182*g*. In alternative embodiments, the arm 46*g* may be secured to the receptacle 150 via fasteners.

The base 182*g* includes a main body 398*g* extending from the first end 181*f* of the base 182*f* to the connection portion 190*f* The main body 398*g* is solid and includes a circular cross-section. However, in some embodiments, the main body 398*g* may include a cross-section of alternative shapes. The main body 398*g* includes rails 402*g* extending from the main body 398*g*. Specifically, the main body 398*g* includes four rails 402*g* extending parallel to each other and equidistantly spaced around the body 398*g*. An elongate slot 166*g*, or aperture, extends through the base 182*g* between the first end 181*g* of the base 182*g* and the connection portion 190*g*. In alternative embodiments, the slot 166*g* may include additional shapes or sizes, and/or extend along a shorter or longer portion of the base 182*g*. In some constructions, the elongate slot 166*g* is recessed within the base 182*g* and does not extend completely through the base 182*g*. Additionally, in alternative embodiments, the base 182*g* may include additional slots.

The first extension 330*g* includes a first end 329*g*, and a second end 331*g* opposite the first end 329*g*. The first extension 330*g* is cylindrical and includes a cut-out extending from the second end 187*g* of the extension 186*g* through a portion of the extension 186*g*. The cut-out forms a solid cylindrical portion 282*g*, and a hollow cylindrical portion 286*g*. The solid cylindrical portion 282*g* includes elongate channels 198*g*, 202*g* extending into sides of the first extension 330*g*. Specifically, the solid cylindrical portion 282*g* includes a first channel 198*g* and a second channel 202*g* extending parallel to each other and positioned on opposite sides of the first extension 330*g*. The solid cylindrical portion 282*g* includes an elongate slot 290*g*, or aperture, extending through the first extension 330*g*. In the illustrated embodiments, the solid cylindrical portion 282*g* includes one slot 290*g*. However, in alternative embodiments, the solid cylindrical portion 282*g* may include fewer or more slots. The hollow cylindrical portion 286*g* includes cut-outs 406*g* extending into the first extension 330*g*. The cut-outs 406*g* are shaped and sized to receive the corresponding rails 402*g* positioned on the main body 398*g* of the base 182*g*. The hollow cylindrical portion 286*g* includes an elongate slot 294*g* extending through the first extension 330*g*. The elongate slot 294*g* extends along an axis parallel to and collinear with an axis of the elongate slot 290*g* of the solid cylindrical portion 282*g*. In the illustrated embodiments, the first extension includes two elongate slots 290*g*, 294*g*. However, in alternative embodiments, the first extension may include fewer or more slots and/or apertures.

The second extension 334*g* includes a first end 333*g*, and a second end 335*g* opposite the first end 333*g*. The second extension 334*g* is cylindrical and includes a cut-out 206*g* extending from the second end 335*g* of the second extension 334*g* through a portion of the second extension 334*g*. The cut-out 206*g* forms a solid portion 210*g*, a first elongate arm 214*g*, and a second elongate arm 218*g*. The elongate arms 214*g*, 218*g* extend from the solid portion 210*g*. The solid portion 210*g* includes an elongate slot 222*g*, or aperture, extending through the extension 334*g*. In the illustrated embodiments the solid portion 210*g* includes one slot 222*g*. However, in alternative embodiments, the solid portion 210*g* may include fewer or more slots. The arms 214*g*, 218*g* extend from the solid portion 210*g* and are oriented parallel to each other and on opposite sides of the extension 334*g*. The arms 214*g*, 218*g* are shaped and sized to be received within the first channel 198*g* and the second channel 202*g* of the first extension 330*g*.

The arm 46*g* may additionally or alternatively include a sleeve, or collar, (not shown) supported by the arm 46*g* movable (e.g., slidable) along the arm 46*g*. The sleeve includes an outer surface engageable by the user to move the sleeve relative to the arm 46*g*. Specifically, the sleeve may be two washers secured together via a fastener (e.g., a bolt, etc.). The sleeve clamps around the arm 46*g* in order to secure the first extension 330*g* and the second extension 334*g* to the base 182*g* in a given position. In some embodiments, the sleeve includes apertures extending through the sleeve. The apertures, the slot 166*g* on the base 182*g*, and the slots 222*g*, 290*g*, 294*g* on the extensions 330*g*, 334*g* are shaped and sized to fasteners (e.g., pins). In the illustrated embodiments, the arm 46*g* includes a first sleeve to secure the first extension 330*g* to the base 182*g* in a given position, and a second sleeve to secure the second extension 334*g* to the first extension 330*g* in a given position.

In order to position the arm 46*g* during operation, the user secures the arm 46*g* to the fixture by threading the connection portion 190*g* of the base 182*g* into the receptacle 150. The user then positions the extensions 330*g*, 334*g* relative to the base 182*g*. Specifically, the user slides the first extension 330*g* relative to the base 182*g* and the second extension 334*g* relative to the first extension 330*g*, causing the hollow cylindrical portion 286*g* of the first extension 330*g* to telescope over the main body 398*g* of the base 182*g*, and the arms 214*g*, 218*g* of the second extension 334*g* to slide along the channels 198*g*, 202*g* of the first extension 330*g*. The extensions 330*g*, 334*g* may be coupled to the base 182*g* in a retracted position (FIG. 22A), a partially extended position, or a fully extended position (FIG. 22B). In the retracted position, the main body of the base 182*g* is seated within the hollow cylindrical portion 286g of the first extension 330g and the arms 214g, 218g of the second extension 330g are seated within the channels 198g, 202g of the first extension 330g. In the partially extended position, the main body 398g of the base 182g is seated within the hollow cylindrical portion 286g of the first extension 330g and the arms 214g, 218g of the second extension 334g are extended out of the channels 198g, 202g of the first extension 330g. In the fully extended position, the main body 398g of the base 182g is extended out of the hollow cylindrical portion 286g of the first extension 330g and the arms 214g, 218g of the second extension 334g are extended out of the channels 198g, 202g of the first extension 330g. The extensions 330g, 334g may additionally be coupled to the base 182g in a plurality of positions between the retracted position and the partially extended position, and a plurality of positions between the partially extended position and the fully extended position.

In order to couple the extensions 330g, 334g to the base 182g in a given position, the user secures the first clamp around the first extension 330g and the base 182g, and the second clamp around the first extension 330g and the second extension 334g. The user then positions fasteners (e.g., pins) through the slots. The fasteners may then protrude through corresponding apertures on the plumbing fixture during use, securing the arm 46g to the plumbing fixture.

Various features and advantages are set forth in the following claims.

What is claimed is:

1. A fixture carrier for supporting a plumbing fixture, the fixture carrier comprising:

an upright; and an arm coupled to the upright and configured to support the plumbing fixture, the arm including a base, and an extension configured to move relative to the base, wherein the arm is configurable in a first position where at least a portion of the base is retracted into the extension, a second position where the extension is extended away from the base, and a plurality of positions between the first position and the second position, and wherein the base includes an aperture and the extension includes an elongate slot, and wherein when the arm is in the second position the aperture is aligned with the elongate slot.

2. The fixture carrier of claim 1, wherein the upright defines a first axis, and the arm defines a second axis oriented perpendicular to the first axis, wherein the extension telescopes relative to the base about the second axis.

3. The fixture carrier of claim 1, further comprising a coupling mechanism configured to couple the arm to the upright.

4. The fixture carrier of claim 3, wherein the coupling mechanism includes a bracket coupled to the upright, and a plate positioned between the bracket and the arm, wherein the plate is coupled to the arm and movable relative to the bracket.

5. The fixture carrier of claim 4, wherein the plate includes a receptacle, wherein the base is threadably coupled to the receptacle.

6. The fixture carrier of claim 1, wherein the aperture and the elongate slot are configured to receive a fastener.

7. A fixture carrier for supporting a plumbing fixture, the fixture carrier comprising:

an upright; and an arm coupled to the upright and configured to support the plumbing fixture, the arm including a first portion coupled to the upright, and a second portion coupled to the first portion and including a bore, wherein the first portion is configured to be threadably received within the bore, wherein the arm is configurable in a first position where at least a portion of the first portion is retracted into the second portion, a second position wherein the first portion is extended away from the second portion, and a plurality of positions between the first position and the second position, and wherein the first portion includes an aperture, wherein the second portion includes an elongate slot, and wherein when the arm is in the second position the aperture is aligned with the elongate slot.

8. The fixture carrier of claim 7, wherein a first end of the first portion includes first threads, and a second end of the first portion includes second threads.

9. The fixture carrier of claim 8, wherein the second threads include a greater pitch than the first threads.

10. The fixture carrier of claim 7, wherein the first portion is threadably coupled to the upright.

* * * * *